US006104817A

United States Patent [19]

Ding

[11] Patent Number: 6,104,817

[45] **Date of Patent: *Aug. 15, 2000**

[54] SPEAKER AND AMPLIFIER SYSTEM

[76] Inventor: Chih-Shun Ding, 6400 Lincoln Ave. #3301, Buena Park, Calif. 90620-3601

[ * ] Notice: This patent is subject to a terminal disclaimer.

[21] Appl. No.: 09/091,194

[22] PCT Filed: Dec. 12, 1996

[86] PCT No.: PCT/US96/19908

§ 371 Date: Jun. 9, 1998

§ 102(e) Date: Jun. 9, 1998

[87] PCT Pub. No.: WO97/22226

PCT Pub. Date: Jun. 19, 1997

[51] Int. Cl.[7] ..... H04R 3/00

[52] U.S. Cl. ..... 381/96

[58] Field of Search ..... 381/96, 59, 58, 381/116, 117, 120, 121

[56] References Cited

U.S. PATENT DOCUMENTS

| | | |
|---|---|---|
| 4,118,600 | 10/1978 | Stahl . |
| 4,276,443 | 6/1981 | Meyers . |
| 4,335,274 | 6/1982 | Ayers . |
| 4,573,189 | 2/1986 | Hall . |
| 4,980,920 | 12/1990 | Noro et al. . |
| 5,031,221 | 7/1991 | Yokoyama . |
| 5,086,473 | 2/1992 | Erath . |
| 5,206,912 | 4/1993 | Noro . |
| 5,537,479 | 7/1996 | Kreisel et al. . |
| 5,588,065 | 12/1996 | Tanaka et al. . |

OTHER PUBLICATIONS

K.G. Stahl, "*Synthesis of loudspeaker mechanical parameters by electrical means: a new method for controlling low–frequency loudspeaker behavior*" in J. Audio Eng. Soc. vol. 29, No. 9, pp. 587–596 (1981).

P.G.L. Mills and M.O.J. Hawksford, "*Distortion reduction in moving–coil loudspeaker systems using current–drive technology*" in J. Audio Eng. Soc. vol. 37, No. 3, pp. 129–148 (1989).

P.G.L. Mills and M.O.J. Hawkford, "*Transconductance power amplifier systems for current–driven loudspeaker*" in J. Audio Eng. Soc. vol. 37, No. 10, pp. 809–822 (1989).

*Primary Examiner*—Vivian Chang
*Attorney, Agent, or Firm*—Oppedahl & Larson LLP

[57] ABSTRACT

A sound reproduction system employs at least one amplifier system and at least one speaker. The speaker provides two negative feedback signals: one indicative of the current through the speaker voice coil and a second indicative of the velocity of the speaker diaphragm. The current signal is provided via a first feedback path to an input of the amplifier in the amplifier system. The velocity signal is provided via a second feedback path to an input of the amplifier. The current signal may be derived from the voltage drop across a resistor placed in series with the speaker voice coil. The velocity signal may be derived from a second voice coil coupled to the diaphragm, or may be derived from a piezoelectric sensor coupled thereto.

54 Claims, 17 Drawing Sheets

$$Z = \frac{cs^3 + ds^2 + es}{as^2 + bs + 1}, \quad G = \frac{Ks}{as^2 + bs + 1},$$

SPEAKER AND AMPLIFIER SYSTEM

TECHNICAL FIELD

The invention relates generally to audio speaker drivers.

BACKGROUND ART

Recent decades have seen numerous developments in high-fidelity sound reproduction. Electronic and mechanical components made available to amplifier manufacturers have permitted the design of amplifiers that have better linearity and frequency response and lower distortion. Such amplifiers are smaller in size, less fragile, and less expensive. The audio sources (e.g. multiplexed stereo FM, digital compact disk, and compact cassette tape) are greatly improved over those previously available, and are dropping in cost. The electrical signals provided to the terminals of the speakers of a stereo sound system are, in present-day times and at modest cost, of a quality and fidelity that would have been unavailable to the consumer of two decades ago, except at prohibitive cost.

Those skilled in the art will appreciate, however, that one aspect of a high-fidelity sound system has remained stubbornly resistant to these improvements, namely the technology whereby the electrical energy of a sound system is converted to accoustic (airborne) energy: the speakers.

FIG. 1 shows the impedance of a electromagnetic speaker driver. It consists of three components: $R_e$ is the voice coil dc resistance, $L_v$ is the voice coil inductance, and the parallel network of $L_m$, $C_m$ and $R_m$ is the motor impedance. The inclusion of $L_m$, $C_m$ and $R_m$ is a result of the energy conversion process between electric energy and mechanical energy in the electromagnetic speaker driver. To be more specific, the mass of the diaphragm causes $C_m$ to appear in the driver's impedance, the friction for $R_m$, and the compliance of the diaphragm assembly for $L_m$. There are known formulae to relate the values of $C_m$, $R_m$ and $L_m$ to the mechanical parameters of the driver. If one puts a driver in a box, the measured impedance changes. There will be a network, which is related to the mechanical parameters of the box, appeared in parallel with the motor impedance. FIG. 2 show the added networks for closed-enclosure and bass-reflexive types of boxes.

The analysis of the frequency response in these systems under a voltage-source input signal can be done as in FIG. 3. $Z_b$ is the added impedance component from the speaker box. In the bass frequency region, the importance of $L_v$ is very minor and hence omitted in FIG. 3. There is an equivalent mechanical system for the electrical system described in FIG. 3*b*. Alternatively, the analysis can be done on the mechanical system and result will be the same. Note that the dc resistance of the voice coil acts as part of the mechanical friction in the driver as seen from FIG. 3*b*.

In general, the bass response of a electromagnetic (boxed) speaker system (that is, the system including a electromagnetic driver (or drivers) and an enclosure in which the driver(s) resides) depends on the mechanical parameters of both the enclosure and the driver itself, as well as the voice coil dc resistance. Examples of the parameters for enclosure are the box volume and port resonance frequency (if the enclosure is ported or vented). Examples of the driver parameters are compliance, mass, and the friction of the diaphragm assembly. These parameters have to be carefully chosen so that the combined system provides good bass response. Very often the design procedure starts with some known parameters in the driver or the enclosure, then calculates the required values for the rest parameters. There are at least two implications here.

First, when one parameter (say enclosure volume) is altered during the design procedure, the drivers need to be redesigned so that they exhibit the new set of required parameters. Second, after one fixes some parameters and then calculates the required values for other parameters, these values may becomes unrealistic to implement mechanically, or the efficiency of the speaker system becomes unacceptable.

Several apparatus have been proposed to address the above-mentioned problem. The first type of apparatus uses a derived signal, which is related to the movement of the diaphragm in the driver, as feedback signal so that the velocity of the diaphragm will exhibit desired characteristics in the frequency domain. For instance, in a closed-enclosure system, the velocity of the diaphragm needs to be inversely proportional to frequency (in the piston frequency region) in order to provide truly flat frequency response. Such a requirement (for the diaphragm velocity) is independent of any mechanical parameters. Therefore, the frequency response of the speaker system does not depend on the mechanical parameters of the enclosure or the driver. The major disadvantage of this type of apparatus is that it is only feasible when the desired velocity is a simple function of the frequency. The closed-enclosure speaker system can be one example. On the other hand, to produce flat frequency response in a bass-reflexive speaker system, the velocity is a complex function of frequency and the mechanical parameters of the enclosure and the driver. This type of apparatus becomes impractical for a bass-reflexive system (or any other ported or vented box system).

The second type of apparatus, in which the output impedance is a combination of a negative resistance and a complex reactance, tries to change the "apparent" mechanical parameters such that they are different from the actual mechanical parameters. In essence, such apparatus provides a mechanism that "changes the mechanical parameters of the drivers electrically". The objective of the negative output resistance is to cancel the dc resistance in the voice coil so that the other part of the output impedance (the complex reactance) can interact directly with the motor impedance and its equivalent effects are the changes of mechanical parameters. One example of these type of apparatus that portrayed in U.S. Pat. No. 4,118,600. That approach can be applied to various type of speaker systems, ranging from closed-enclosure to bass-reflexive systems. However, a major problem with that approach is that the dc resistance in the voice coil is highly dependent on the temperature and hence the result of cancellation is not guaranteed in practice. For instance, copper, which is the most commonly used material for voice coils, has a temperature coefficient about 0.2%/° F. In the bass frequency region, the signals sustain longer than those in the other frequency region. Combined with the fact that the hearing threshold of human ears in bass frequency region is typically quite high, there will be a significantly higher amount of electric energy dissipated in the voice coils. The result is that the frequency response depends on the voice coil temperature, and hence is not stable. A major problem with the system proposed therein is the negative output resistance. As will discussed below, the system according to the invention avoids this problem.

An approach to the temperature-shift problem is suggested in U.S. Pat. No. 4,980,920. The patent suggests a temperature compensation circuit to address this problem, but the result is hardly satisfactory in practice as issues such as thermo-coupling between the voice coil and the temperature sensor, and the linearity of sensor outputs, challenge the long-term stability of such a system.

DISCLOSURE OF INVENTION

An improved sound reproduction system employs an amplifier system and a speaker. The speaker provides two feedback signals, one indicative of the current through the speaker voice coil and a second indicative of the velocity of the speaker diaphragm. The velocity signal is provided via the first feedback path to an input of the amplifier of the amplifier system. In one embodiment, the current signal is provided by the second feedback path through a bandpass filter to the amplifier input. The velocity measurement may be derived from a second voice coil coupled to the diaphragm, or may be derived from a piezoelectric sensor coupled thereto. The current signal may be derived from the voltage drop across a resistor placed in series with the speaker voice coil.

Preferably the bandpass filter characteristics (and optionally the velocity-derived first feedback characteristics) are optimized with respect to the electrical and mechanical characteristics of the speaker and its enclosure. This matching may be accomplished by means of fixed components in an amplifier system that is dedicated for use with a particular speaker and enclosure. Optimally, however, the matching is accomplished so that the amplifier system is usable with any of a number of speaker/enclosure arrangements. A circuit card is provided with the speaker system, and electrical components in the circuit card are selected in relation to the electrical and mechanical characteristics of the speaker system. The circuit card is plugged into a connector at the amplifier system, and in this way the feedback coupling is optimized for the particular speaker system associated with that circuit card.

Stated differently, the objective of the present invention is to provide a driving apparatus for a speaker system so that the apparent mechanical parameters of the driver are different from the actual parameters without putting a negative resistance in the output impedance of the apparatus, in order to achieve excellent and stable bass frequency response. This objective is achieved using a combination of current sensing and notional signal feedback. That is, the signals correspondent to the current flow through the voice coil of the driver and movement of the diaphragm are put in the closed loop of the driving apparatus so that the equivalent effect of the arrangement is the change in the apparent mechanical parameters of the driver.

BRIEF DESCRIPTION OF DRAWINGS

The invention will be described with respect to a drawing, of which.

MODES OF CARRYING OUT THE INVENTION

Figure 1:
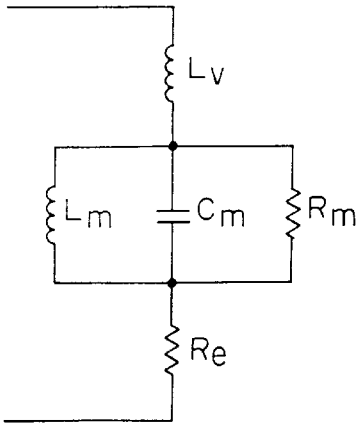
FIG. 1 shows in schematic form an impedence model for a generalized audio speaker.
Figure 2:
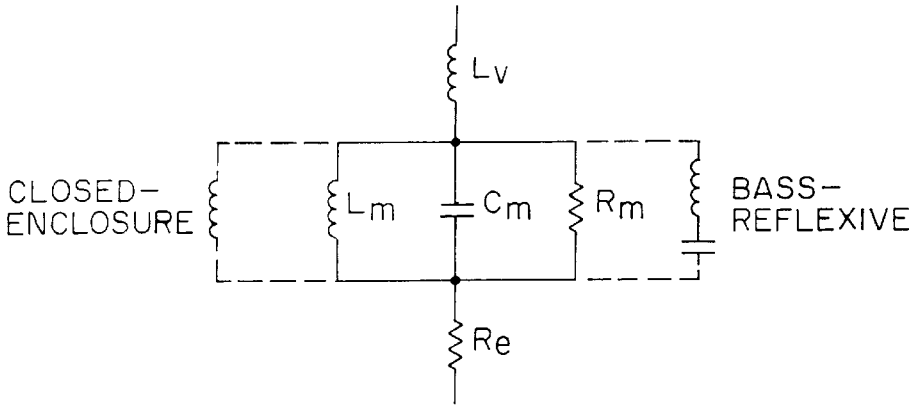
FIG. 2 shows the model of FIG. 1 with additional components modeling a speaker in an enclosure.
Figure 3A:
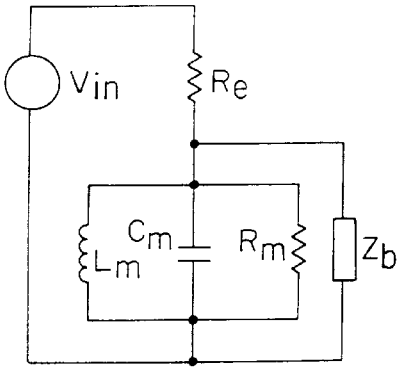
FIGS. 3*a* and 3*b* show equivalent circuits resulting from analysis of the frequency response of the system of FIGS. 1 or 2.
Figure 3B:
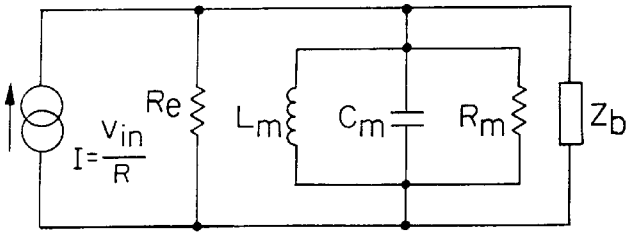
Figure 4:
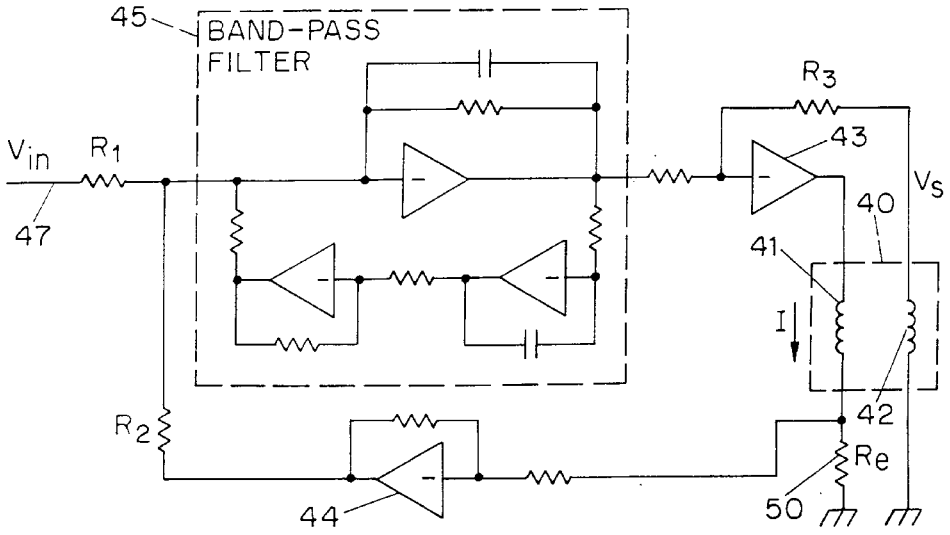
FIG. 4 shows in functional block diagram form an embodiment of the invention.

FIG. 4 shows one embodiment of the present invention. The speaker driver 40 has two voice coils 41, 42. Coil 41 is used as the load for the amp 43 to convert electrical energy to mechanical energy. The second voice coil 42 is for deriving the motional (velocity) feedback signal. The voltage applied to the driving voice coil 41 has two components: one is the drop across the dc resistance of the voice coil 41 and the other is the induced voltage caused by the movement of voice coil in the static magnetic field of the speaker. The latter is exactly the voltage drop across the motor impedance in FIG. 1. (This is statement is, of course, an approximation as the inductance of the voice coil 41 also contributes part of the induced voltage. However, let us now assume $L_v$ is very small and can be ignored.) Assume that these two voice coils 41, 42 are closely coupled (for instance, wound on the same former or coilform) so that the induced voltage at the sensing voice coil 42 $V_s$ is a constant factor $K_s$ of the induced voltage of the driving voice coil 41 $V_d$. That is, $$V_s = K_s \cdot V_d$$

Moreover, if $R_3$ is very high so that very little current is drawn from the sensing voice coil 42, then the voltage drop due to the dc resistance of the sensing voice coil 42 can be ignored. Therefore the voltage drop between the two terminals of sensing voice coil 42 is exactly $V_s$.

Figure 5:
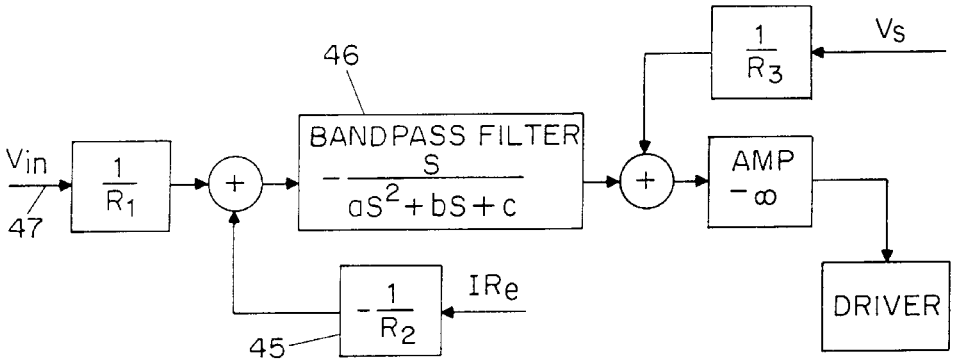
FIG. 5 shows an equivalent transfer function diagram for FIG. 4.

FIG. 5 shows the block diagram of FIG. 4. Let us assume the gain of the bottom inverter 44 in FIG. 4 is −1, therefore the sign of $1/R_2$ 45 in FIG. 5 is negative. Furthermore, the transfer function 46 of the basspass filter 45 is assumed as shown in FIG. 5. If the amp 43 has infinite gain, then the input to the amp 43 should be zero, that is, $$\left(-V_{in}\cdot\frac{1}{R_1}+\frac{R_e}{R_2}I\right)\left(\frac{S}{aS^2+bS+c}\right)+\frac{V_s}{R_3}=0 \tag{4}$$

$$\left(-V_{in}\cdot\frac{1}{R_1}+\frac{R_e}{R_2}I\right)\left(\frac{S}{aS^2+bS+c}\right)+\frac{K_s\cdot V_d}{R_3}=0$$

$$-\frac{R_3}{R_1K_s}\left(\frac{S}{aS^2+bS+c}\right)V_{in}+\frac{R_eR_3}{R_2K_s}\left(\frac{S}{aS^2+bS+c}\right)I+V_d=0$$

$$\text{or}\quad \frac{R_3}{R_1K_s}\left(\frac{S}{aS^2+bS+c}\right)V_{in}=\frac{R_eR_3}{R_2K_s}\left(\frac{S}{aS^2+bS+c}\right)I+V_d$$

where I is the current flow through the driving voice coil 41.

Figure 6A:
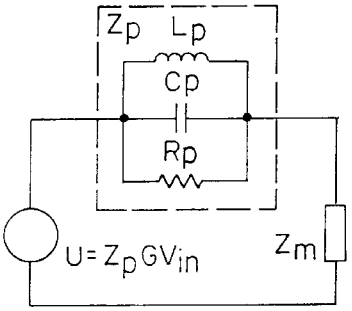
FIGS. 6*a,* 6*b* and 7 show equivalent circuits to FIG. 5.

Equation (4) shows that the system amplifies the input signal 47 with a magnitude of basspass characteristics, drives the motor impedance $Z_m$ of the driving voice coil 41 and has an output impedance equivalent to a parallel network consisting of R, L and C components as shown in FIG. 6. Note that $V_d = Z_m I$.

The values of the components in FIG. 6 are as follows:

$$G=\frac{R_2}{R_1R_e}$$

$$C_p=\frac{R_2K_sa}{R_eR_3}$$

$$R_p=\frac{R_eR_3}{R_2K_sb}$$

$$L_p=\frac{R_eR_3}{R_2K_sc}$$

Figure 6B:
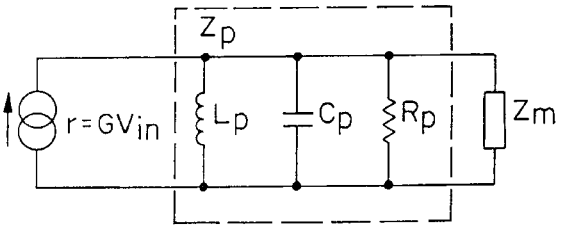
Figure 7:
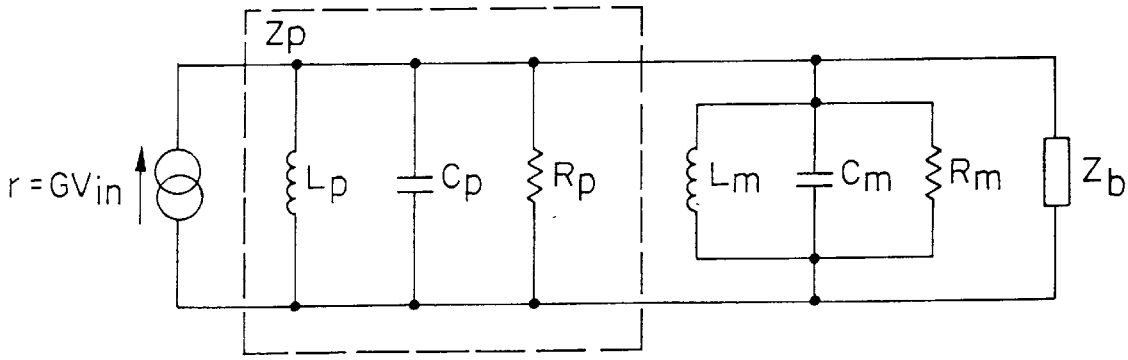

If I expand $Z_m$ in FIG. 6*b*, I get FIG. 7.

As implied in FIG. 7, $Z_p$ can be combined with $Z_m$ so that the system acts as if the driver has a different set of parameters. More importantly, this is done without using a negative resistance in the output impedance.

The circuit in FIG. 4 can be made much simpler as will now be described.

In general the required value $R_p$ in $Z_p$ (FIG. 7) is very small so that the transfer function of the bandpass filter has real-value poles, that is $$\frac{S}{aS^2+bS+c}=\frac{S}{(dS+e)(fS+g)} \tag{9}$$

Figure 8A:
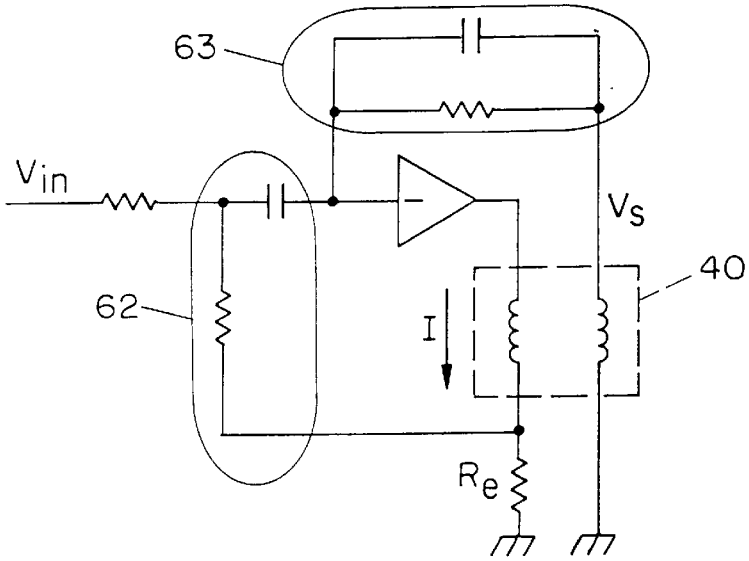
FIGS. 8*a* and 8*b* show simplified embodiments of the system of FIG. 4.

This reduces the circuit of FIG. 4 to the one of FIG. 8*a*. If only $_{Cm}$ and $R_m$ need to be modified (that is, only $C_p$ and $R_p$ need to be in $Z_p$ of FIG. 7), then the circuit can be simplified to that of FIG. 8*b*. It will be appreciated, however, that these are very ideal cases. When one apply the techniques described here to real-world speaker drivers, at least two issues need to be considered: (1) dc offset voltage of the amp 43, and (2) the impact of $L_v$ on the frequency response.

Figure 8B:
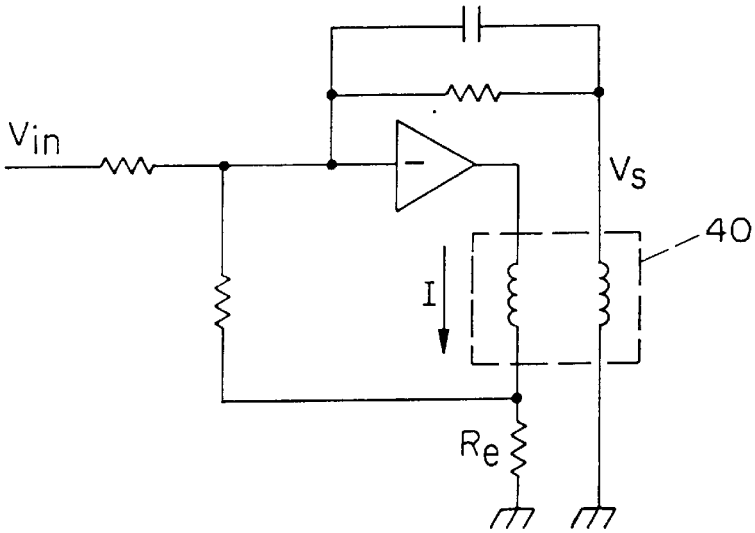
Figure 9A:
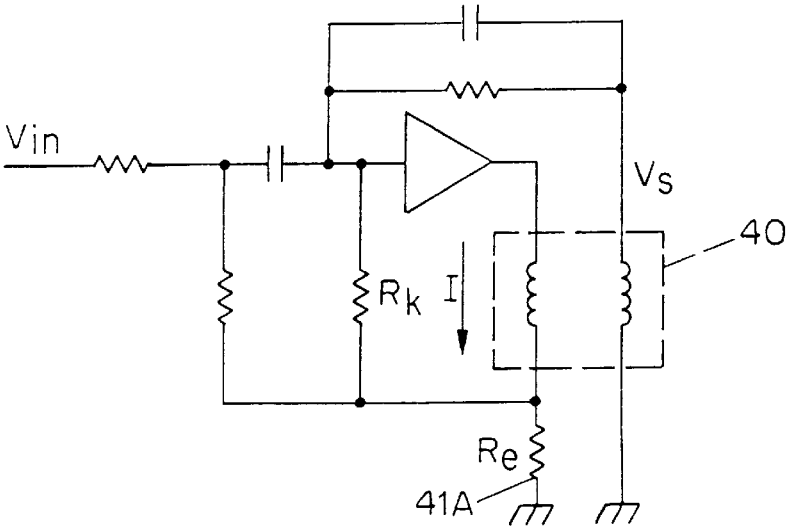
FIGS. 9*a* and 9*b* shows embodiments of the invention employing DC feedback.
Figure 9B:
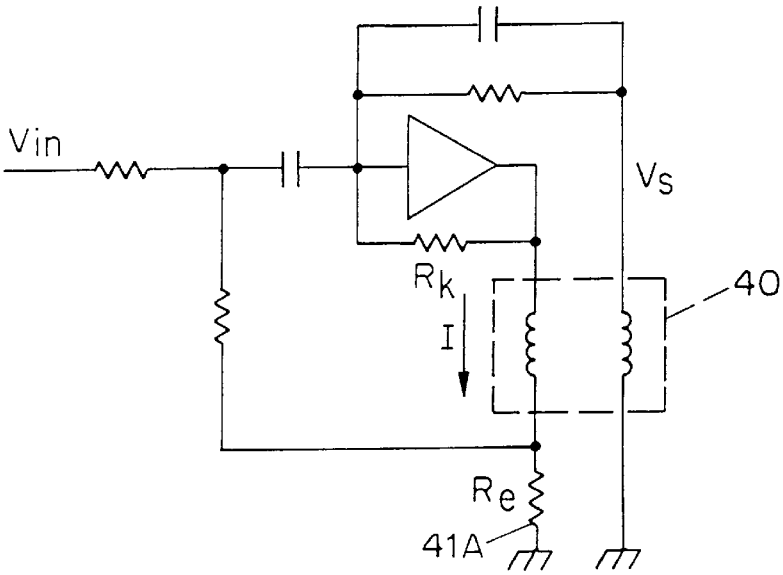
Figure 10:
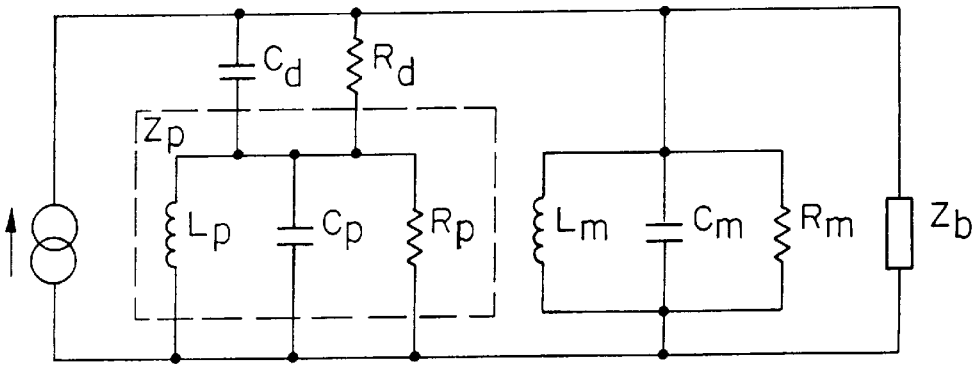
FIG. 10 shows an equivalent circuit for FIGS. 9*a* and 9*b;*

As may be appreciated from FIG. 8*a*, there is no DC feedback, as a result of which the system is not stable at DC. FIG. 8*b* does have DC feedback, so does not present this problem. There are at least two solutions here. First, one may add a DC feedback loop either from the current sensing resistor (FIG. 9*a*) or from the amp's output (FIG. 9*b*). Either way $Z_p$ is no longer a network of three components as modeled in FIG. 7. FIG. 10 shows the new $Z_p$, which may be compared with that of FIG. 7.

The impact of $C_d$ and $R_d$ on frequency response can be minimized by using higher value of $R_k$ in FIG. 9.

Figure 11:
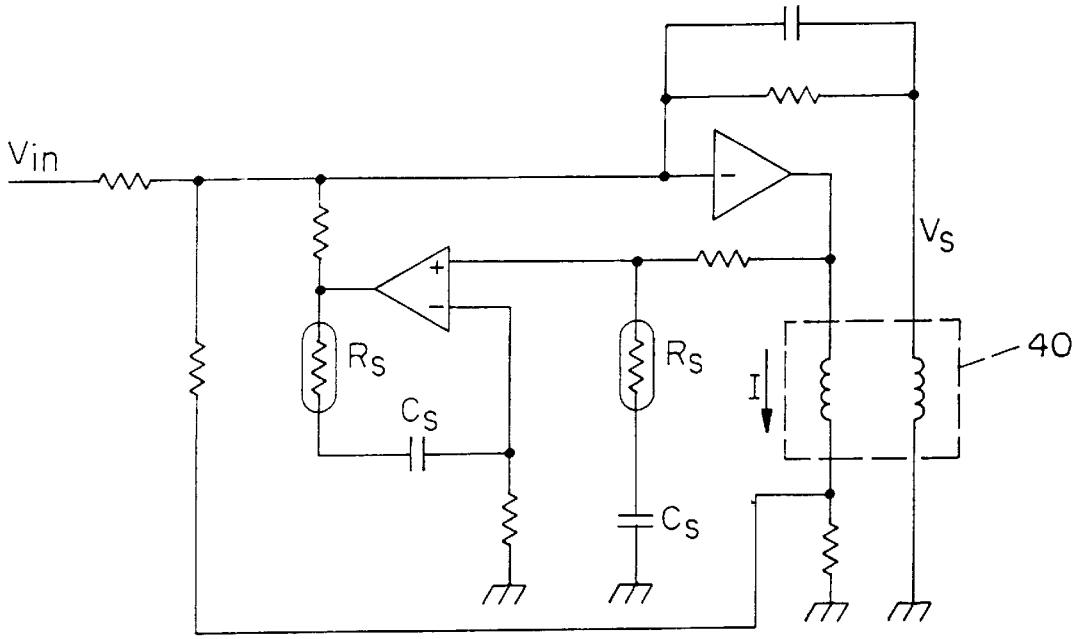
FIG. 11 shows an embodiment of the invention employing a DC servo loop.
Figure 12A:
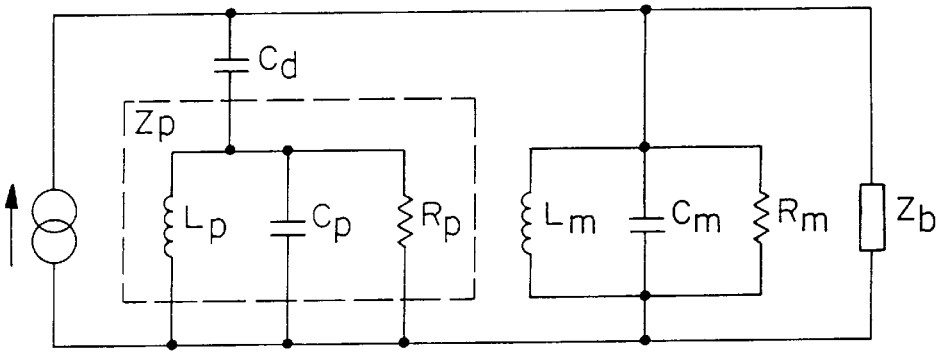
FIGS. 12*a* and 12*b* show equivalent circuits for the system of FIG. 11.

Another solution to the DC stability issue is to add a DC servo loop in the system. One possible configuration is shown in FIG. 11. The equivalent circuit of FIG. 11 is shown in FIG. 12*a*.

Figure 12B:
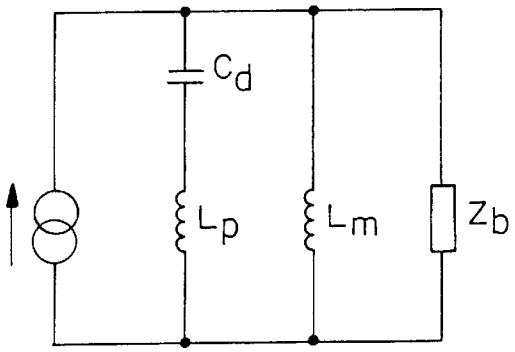

A potential problem with DC servo loops is the possibility of low-frequency oscillation. The equivalent circuit at very low frequency is shown in FIG. 12*b*, which is an LC network with no damping resistor. The remedy is to add a serial resistor to $C_s$ in FIG. 11 so that the equivalent circuit becomes similar to FIG. 10.

Figure 13A:
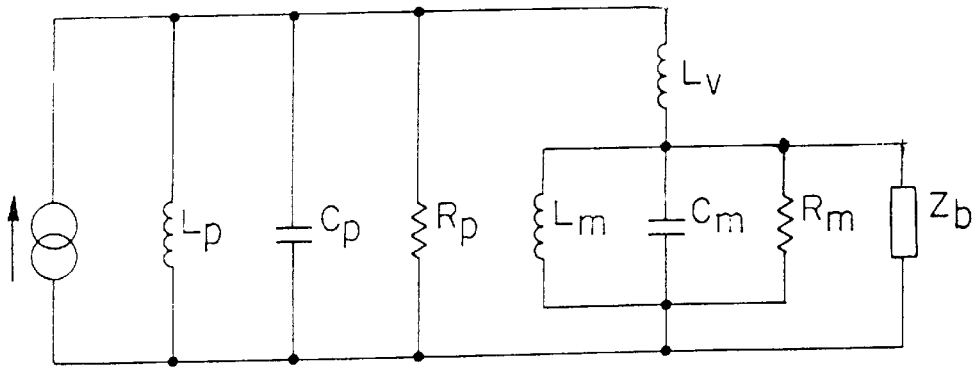
FIGS. 13*a* and 13*b* show counterparts to FIGS. 12*a* and 12*b* taking $L_v$ into account.
Figure 13B:
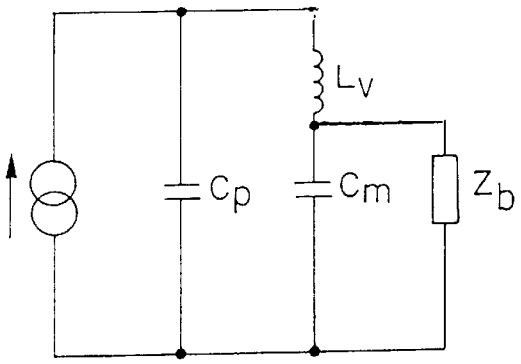

Another potential problem (from $L_v$) also is addressed. The voltage drop across $L_v$ is supposed to be part to the induced voltages $V_d$ and $V_s$. Previous analysis ignores it because we assume its effect is very small. If the analysis is to be more general, however, it is necessary to consider the case in which its effect is not small. (Experience shows that it is not easy, nor cheap, reduce the value of $L_v$.) The impact of $L_v$ to frequency response is restricted to high frequency. FIGS. 13*a* and 13*b* shows the equivalent circuit with $L_v$ considered.

Figure 14:
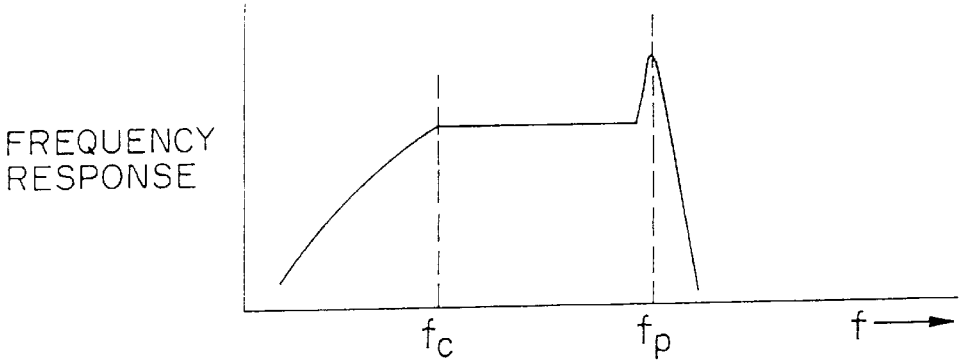
FIG. 14 shows the response of a system according to the present invention.

FIG. 14 shows the actual response of a system employing the present invention. The $f_c$ in FIG. 14 is the cut-off frequency of the speaker system. The peak at $f_p$ is caused by $L_v$, $_{Cm}$ and $C_p$. Another impact of $L_v$ is the increased distortion at frequencies nearby to $f_p$. This is because $L_v$ is not a constant value. As a matter of fact, it is the major source of distortion at high frequency.

One investigator has addressed this problem by a particular current-drive technology. As $L_v$ changes, $f_p$ also changes. Translating it to time domain, it means that the distortion is significantly increased around $f_p$ and above.

Figure 15A:
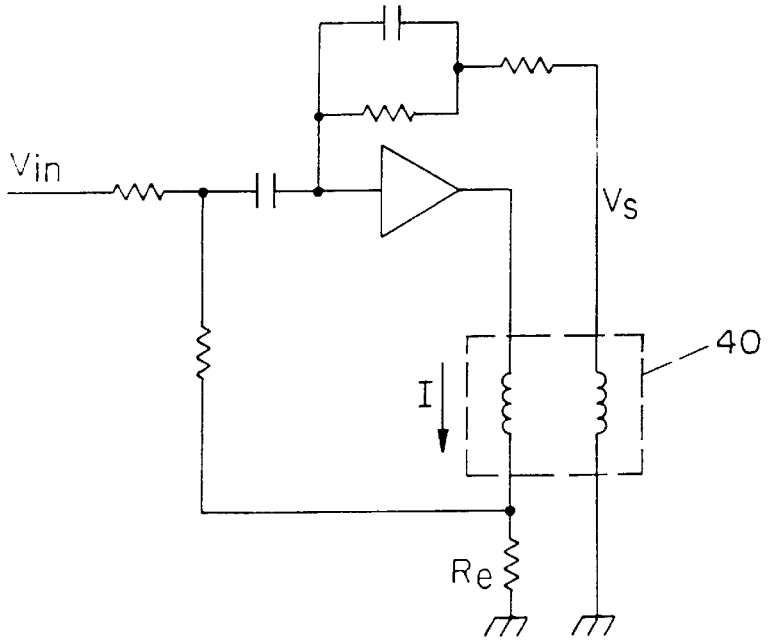
FIG. 15*a* shows an embodiment of the invention in which a resistor is included in the velocity feedback path.
Figure 15B:
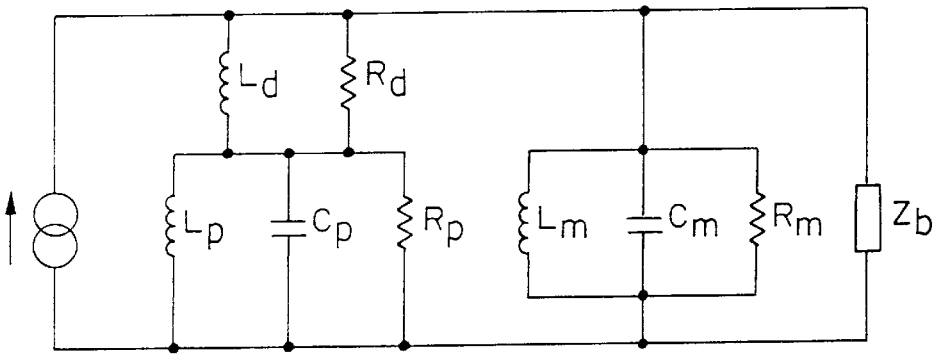
FIG. 15*b* shows an equivalent circuit for FIG. 15*a;*

One solution to this problem is using two drivers in one box: one facing inward and one facing outward. This arrangement can cancel the odd-order harmonic distortion. For the even-order harmonic distortion, there is little one can do without radical change in the driver mechanical structures. Another possibility to reduce the impact is putting a resistor in series with the $Z_p$ in FIG. 7 so that the peak at $f_p$ is reduced. The problem is that, in the circuit of FIG. 8, it is very difficult to include exactly one resistor. One approach is that of FIG. 15*a*. FIG. 15*b* shows the equivalent circuit.

As will be appreciated by those skilled in the art, there are engineering trade-offs. Of course those skilled in the art can devise obvious variants of the embodiments shown here, all of which are intended to be encompassed by the invention as defined by the claims that follow.

The concept of impedance loading, as I have demonstrated here, can be extended. Let me define the loading in FIG. 7 as simple impedance loading, and the loading in the other figures as complex impedance loading. The impact of the complex impedance loading is that the frequency response could deviate from the ideal cases (simple impedance loading). This characteristic is very helpful as one can implement (part of) the filtering function required to crossover to high frequency speaker driver using complex impedance loading. A computer program can be very helpful in tabulating all possible combinations of values for each commonly used alignment.

The derivation of the motional feedback signals will now be described. Many mechanisms have been proposed for derivation of the motional feedback signals. In the preferred embodiment, the driving and sensing voice coils are wound on the same former and closely placed. It is the cheapest way to do it and is commercially available. In these cases, the velocity signal is derived. Alternatively, one can use piezoelectric accelerometers, in which case the derived signals are the acceleration of the diaphragm, rather than the velocity, in which case the system of the present invention must be modified accordingly. In FIG. 4, for example, either the bandpass filter is changed to a high-pass filter, or the feedback resistance is replaced by an inductance. Either way, the network can still be decomposed, and what changes is the precise nature of the piezo feedback loop. Yet another approach is simply to take the piezo output and convert it to a velocity signal, for example through integration.

As will be appreciated, what is provided is a system offering compact-sized bass reproduction speakers, in which the required mechanical parameters are difficult to implement mechanically. Improved bass response is provided. Such a system offers its benefits especially with car (automotive) stereo systems and home theater systems. One advantage is the simplicity of the apparatus compared with other prior art approaches.

Returning to equation 9 I have:

$$\frac{S}{aS^2+bS+c}=\frac{S}{(dS+e)(fS+g)}=\frac{\left(\frac{1}{fS+g}\right)}{\left(\frac{dS+e}{S}\right)}$$

Figure 16A:
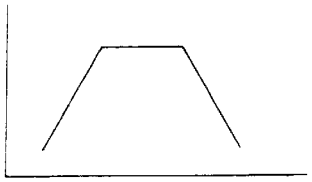
FIG. 16*a* shows a generalized bandpass filter.
Figure 16B:
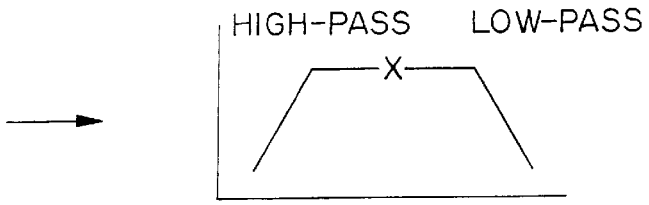
FIG. 16*b* shows the decomposition of such a filter into distinct high-pass and low-pass filters.

The denominator is the impedance of the feedback network for the current signal and the system input signal (for example the circuitry 62 in FIG. 8*a*); the numerator is the impedance of the feedback network for the velocity signal (for example circuitry 63 in FIG. 8*a*). In FIG. 16, the high-pass filtered is assigned to the current feedback signal and low pass is assigned to the velocity feedback signal. Alternatively, one can assign the low pass filter to current feedback signal and high-pass filter to motional feedback signal. In the following, we limit our discussion to the filter assignment described in FIG. 16 as the other case is similar. In other words, the bandpass filter (for example filter 45 in FIG. 4) is decomposed into distinct filters.

In one variant, if a=0 in the bandpass filter, the velocity feedback network can be replaced by a signal resistor.

In another variant, if c=0 in the bandpass filter, the current feedback network can be replaced by a single resistor.

I refer to the technique described above as simple impedance loading. In practice, one may want to modify this technique to resolve real-world problems. For instance, in simple impedance loading, I assume that the impact of voice coil inductance is negligible. When this inductance is large, it adds a lowpass characteristic to the system as depicted in FIG. 14 and the whole system exhibits a bandpass characteristic. One may want to control the Q value of the upper cut-off frequency so that the system has a smoother response. Or one may want to control both upper cut-off frequency and its Q so that the system exhibits a desirable crossover characteristic. In the following, I will describe a scheme, called "complex impedance loading," to achieve this goal. I will assume that the system utilizes a bass reflexive configuration. Other enclosure configurations, such as closed-enclosure, can be similarly considered.

Figure 22A:
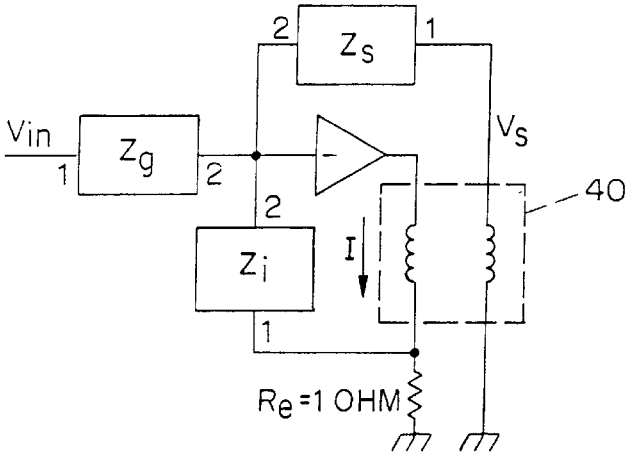
FIG. 22*a* shows a block diagram of complex impedence loading.
Figure 22B:
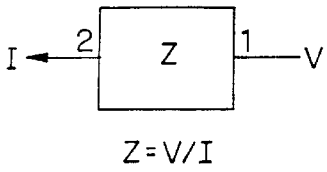
FIG. 22*b* shows a block diagram of complex impedence loading with voltage-controlled current sources.

I first show the block diagram of complex impedance loading in FIG. 22*a*, and then derive the transfer function of the system in terms of the transfer function in each block. FIG. 22*a* is modified from FIG. 8(*a*). The shaded boxes in FIG. 22*a* are two-port networks (either active or passive). They are essentially voltage-controlled-current-sources as shown in FIG. 22*b*. For the sake of simplicity, we that assume $R_e$=1 ohm, the gain of the amp is infinity, and the sensing voice coil exactly reproduces the induce EMF on the voice coil inductance and the motion-induced EMF. As a result I have:

$$\frac{V_{in}}{Z_g}+\frac{I}{Z_l}+\frac{V_s}{Z_s}=0 \tag{10}$$

$$-\frac{Z_s}{Z_g}V_{in}=\frac{Z_s}{Z_l}I+V_s$$

The system is equivalent to one that drives the motional impedance of the speaker with a voltage source of $-(Z_s/Z_g)V_{in}$, through an output impedance network of $Z_a/Z_I$. The major difference between this scheme and simple impedance loading is that, in the latter, $Z_g$ is simply scale-up or scale-down of $Z_I$. I rewrite (1) as:

$$GV_{in}=ZI+V_s$$

where $G=-Z_s/Z_g$ and $Z=Z_s/Z_I$.

Figure 23:
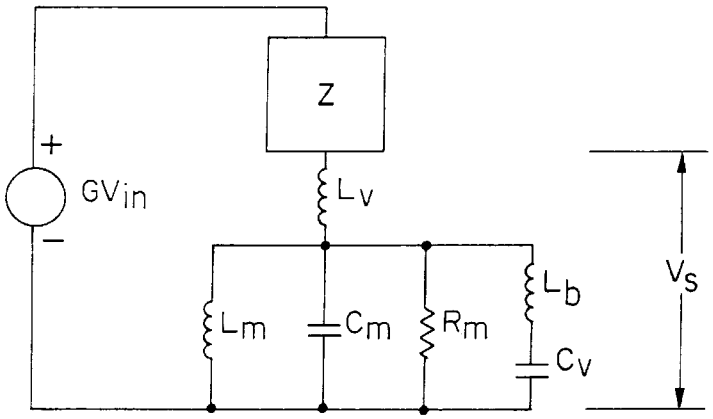
FIG. 23 shows an equivalent system for a bass-reflexive configuration.

For a bass-reflexive configuration, the equivalent system is shown in FIG. 23.

The acoustic output of the system is calculated as the voltage drop across $L_b$, multiplied by s (in the context of a Laplace transformation). I first derive the impedance of the subnetwork comprising of $L_m$, $C_m$, $R_m$, $L_b$, and $C_v$ (which we refer to as the motional impedance subnetwork), and then the voltage drop across this subnetwork. Then I calculate the dividing ratio of $L_b$ in the divider network of $L_b$ and $C_v$. By multiplying the voltage drop and the dividing ratio, we can compute the voltage drop across $L_b$ and multiply it by s to get the acoustic output of the system as described next. The impedance of the motional impedance subnetwork is:

$$\frac{R_m L_m s(L_b C_v s^2 + 1)}{(R_m + L_m s + R_m L_m C_m s^2)(L_b C_v s^2 + 1) + R_m L_m C_v s^2}$$

I will simplify the above expression as:

$$\frac{AsN_m(s)}{D_m(s)}$$

where $A=R_m L_m$, $N_m(s)=L_b C_v s^2+1$, and $Dm(s)=(R_m+L_m s+R_m L_m C_m s^2)(L_b C_v s^2+1)+R_m L_m C_v s$.

Note that, $N_m(s)$ and $D_m(s)$ are second- and fourth-order, respectively.

Next, I assume that Z, which is the output impedance in the complex loading scheme, is written as:

$$Z = \frac{N_z(s)}{D_z(s)}$$

Therefore the voltage drop on the motional impedance subnetwork is:

$$\frac{\frac{AsN_m(s)}{D_m(s)}}{\frac{AsN_m(s)}{D_m(s)} + L_v s + \frac{N_z(s)}{D_z(s)}} \cdot GV_{in}$$

The dividing ratio of $L_b$ in the $L_b$, $C_v$ subnetwork is $$\frac{L_b s}{L_b s + \frac{1}{C_v s}} = \frac{L_b C_v s^2}{N_m(s)}$$

Therefore, the acoustic output of the system is:

$$\left(\frac{\frac{AsN_m(s)}{D_m(s)}}{\frac{AsN_m(s)}{D_m(s)} + L_v s + \frac{N_z(s)}{D_z(s)}}\right)\left(\frac{L_b C_v s^2}{N_m(s)} GV_{in}\right) s \cdot GV_{in} = \frac{AD_z(s)L_b C_v s^4}{AsN_m(s)D_z(s) + L_v s D_m D_z(s) + N_z(s)D_m(s)} \cdot GV_{in} \tag{11}$$

Figure 24A:
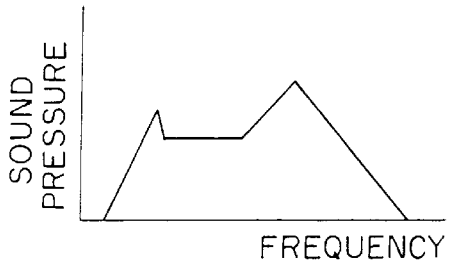
FIG. 24*a* shows a typical frequency response of a system without complex loading.
Figure 24B:
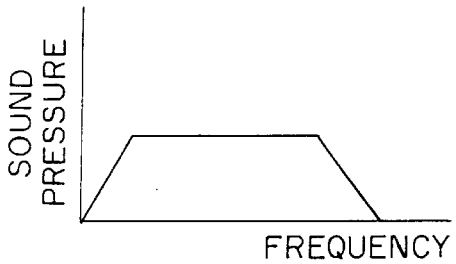
FIG. 24*b* shows a frequency response of a system with complex loading.

One can easily verify that, when $L_v$ is 0, G is a constant, and Z is pure resistive, the overall system exhibits a 4th order high-pass characteristic, just as what an ordinary bass-reflexive system should be, If $L_v$ is nonzero, G is a constant, and Z is pure resistive, the system becomes a 5th order band-pass: 4th order high-pass and 1st order lowpass. However, this is not a very desirable result. FIG. 24*a* shows a typical frequency response of a system without simple or complex impedance loading. The objective of the complex impedance loading system is to control both high-pass and lowpass characteristics so that the system is useful over a wider frequency range, as shown in FIG. 24*b*.

In equation (11), the parameters that will affect the overall system response are:

1) $N_z$ and $D_z$: One can increase the order of one of these two terms, or both.
2) G: Previously, I have assume that the input is a constant voltage source, that is, G is some constant. If I allow G to exhibit frequency-dependent, or filtering, characteristic, I can have more flexibility in controlling the frequency response of the resulting system.

On the other hand, I do not want to make the above parameters so complicated that they add difficulties to the analysis. One arrangement that I describe is as follows:

1) Make $D_z(s)$ 2nd order.
2) Make $N_z(s)=sN_z'(s)$, where $N_z'(s)$ is 2nd order. Therefore Z can be written as:

$$Z = \frac{sN_z(s)}{D_z(s)} = \frac{cs^3 + ds^2 + es}{as^2 + bs + 1}$$

3) Make $$G = \frac{Ks}{D_z(s)} = \frac{Ks}{as^2 + bs + 1}$$

The response of the resulting system is 6th order: 4th order high-pass and 2nd order low-pass. Note the scope of the invention is not limited to the above arrangement. Other arrangements are also possible and can be analyzed similar to method that I use below.

Figure 25A:
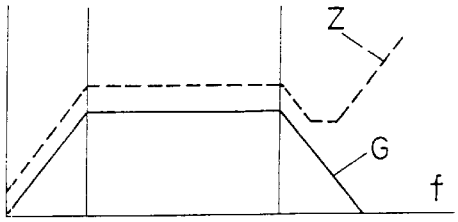
FIGS. 25*a* and 25*b* show two possible Bode plot combinations of Z and G.
Figure 25B:
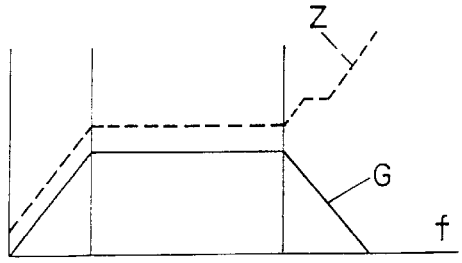
Figure 26A:
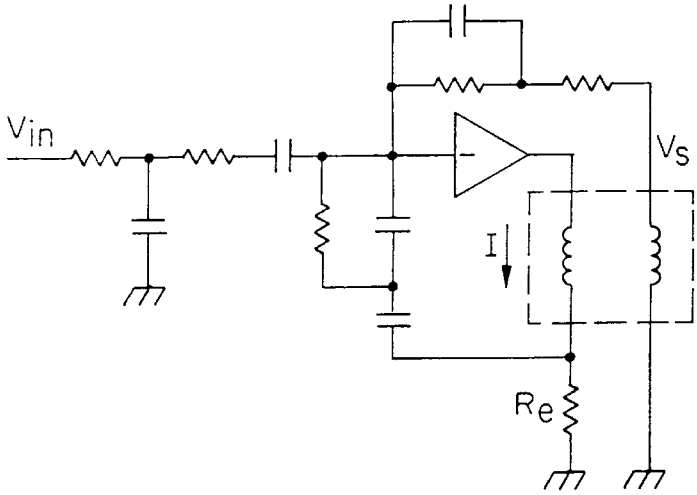
FIGS. 26*a* and 26*b* shows possible circuit implementations corresponding to the two cases of FIGS. 25*a* and 25*b;*
Figure 26B:
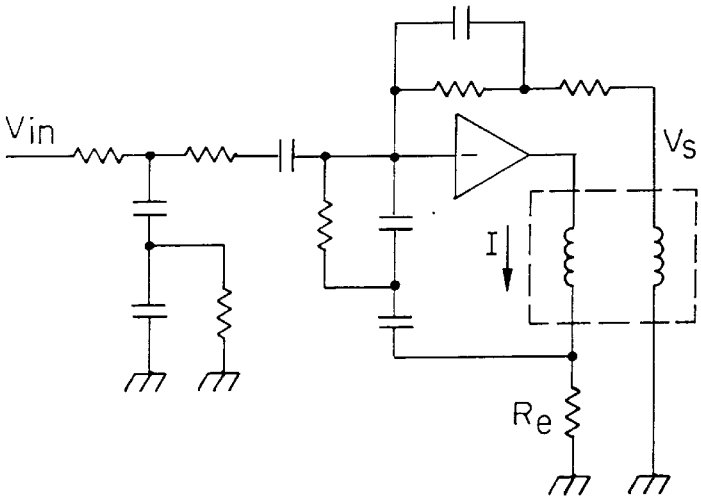

When all the poles and zeros in G and Z are real numbers, the three shaded blocks in FIG. 22*a* can be implemented entirely out of passive elements. In this case, two possible bode plot combinations of Z and G are shown in FIGS. 25*a* and 25*b*. FIGS. 26*a* and 26*b* shows possible circuit implementations corresponding to these two cases.

The difference between the described apparatus and that proposed in U.S. Pat. No. 4,118,600 is summarized in FIG. 27:

1) The complex loading scheme drives the motional impedance directly, therefore eliminate the need of a negative output resistor used in the apparatus proposed in U.S. Pat. No. 4,118,600.
2) The voltage source in the apparatus proposed in U.S. Pat. No. 4,118,600 is proportional to the Zp, while in complex loading, the voltage source, determined by G, needs not to be proportional to Z. That is, the voltage source can be arranged independent of Z.
3) The Z in the complex impedance loading scheme can no longer be represented by a parallel network of RLC, as in the case of prior art U.S. Pat. No. 4,118,600.

In the following, we show a practical design example implementing complex impedance loading.

Design Example 1

Figure 27A:
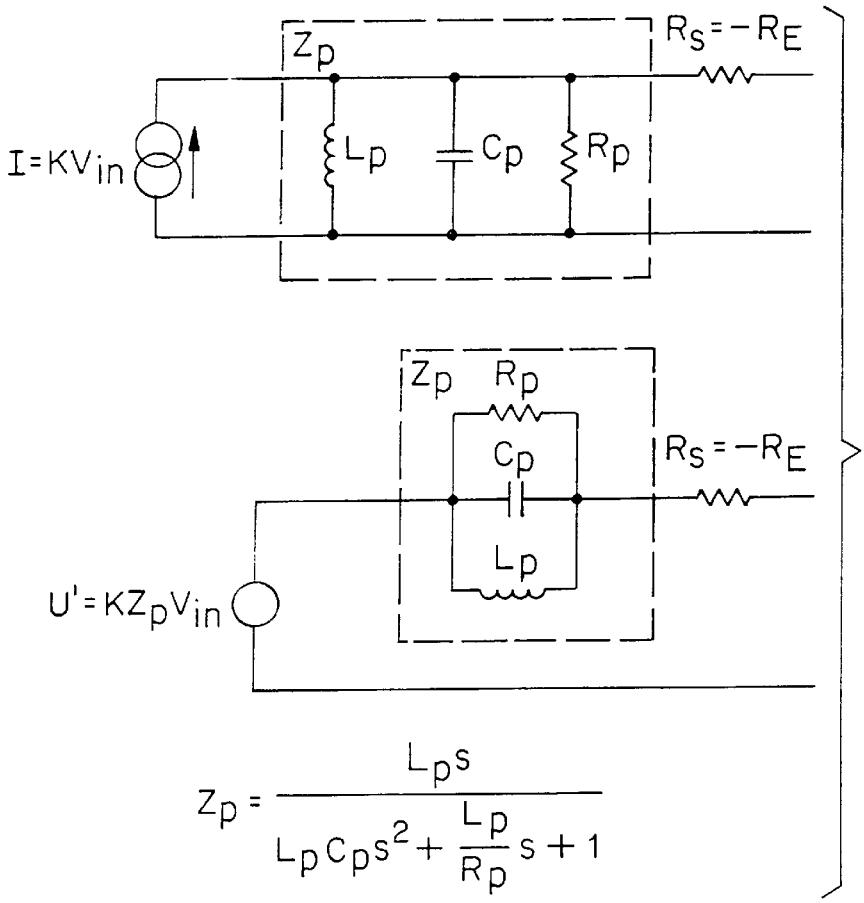
FIG. 27*a* shows the apparatus of prior art U.S. Pat. No. 4,118,600.
Figure 27B:
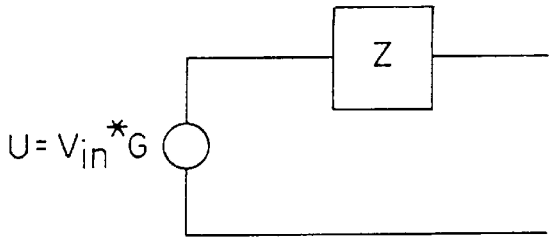
FIG. 27*b* shows the described apparatus in contradistinction to FIG. 27*a;*
Figure 27C:
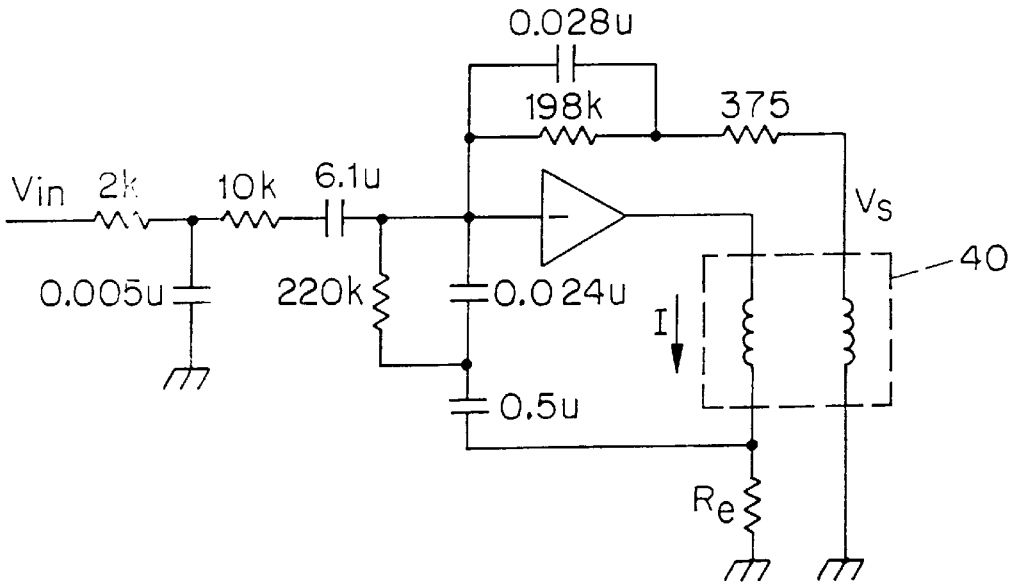
FIG. 27*c* shows a design example corresponding to the described system of FIG. 27*b;*

The driver is a 12-inch woofer. The enclosure is of bass reflexive configuration with internal volume of 74 liters. The Helmholtz resonator of the enclosure is tuned to 20 Hz. The measured component values in the motional impedance network are: $L_v$=1 mH, $R_m$=13 ohm, $L_m$=24 mH, $C_m$=2500 uF, $C_v$=7600 uF, $L_b$=8.3 mH. The design objective is to make the low-end cut-off frequency around 20 Hz(−4 dB) and high-end cut off frequency around 100 Hz with Q=0.7. The design result is:

$$Z = \frac{0.000011s(s+180)(s+89985)}{(s+172)(s+8.7)} \quad (12)$$

and $$G = \frac{Ks}{(s+172)(s+8.7)} \quad (13)$$

where K is a constant that determines the gain of the system. The complete design is shown in FIG. 27.

In practice, simplifications on Z and G are possible. In the following, I will use design example 1 to illustrate the idea.

Simplification scheme (a): if the highest zero in the nominator of Z, (12), is located outside the frequency range I am interested in, e.g. 10–200 Hz, it can be replaced by a constant value of 89985. The G remains unchanged and the new Z becomes:

$$Z = \frac{0.99s(s+180)}{(s+172)(s+8.7)}$$

Simplification scheme (b): if the lowest poles in the denominator of Z, (12), and G, (13), are located outside the frequency range I am interested in, e.g. 20–200 Hz, they can be replaced by expression s. The new Z and G are:

$$Z = \frac{0.000011(s+180)(s+89985)}{s+172}$$

$$G = \frac{K}{s+172}$$

Simplification scheme (c): if the lower zero (the term (s+180) in (12)) and higher pole (the term (s+172) in (12)) are very close, they can cancel each other out. The G remains unchanged while the new Z becomes:

$$Z = \frac{0.000011s(s+89985)}{(s+8.7)}$$

The above three simplifications can be combined. In the following, I will show some examples based on design example 1.

Design Example 2

If I apply both simplification schemes (a) and (b), Z and G become:

$$Z = \frac{0.99(s+180)}{s+172}$$

$$G = \frac{K}{s+172}$$

Figure 28:
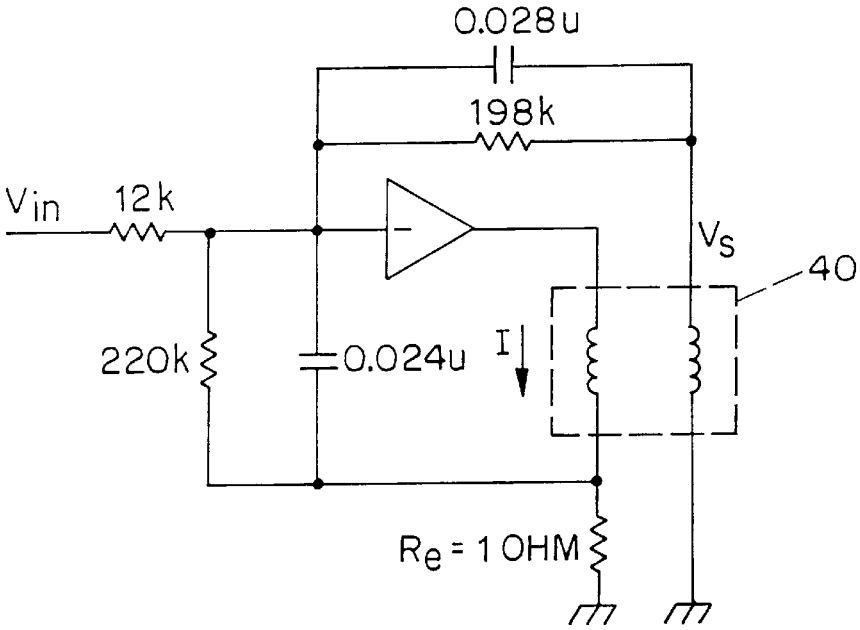
FIG. 28 is a circuit design resulting from two simplification schemes.

The circuit design is shown in FIG. 28.

Design Example 3

If I apply all the simplification schemes, the new Z and G become:

$$G = \frac{K}{s+172}$$

$$Z = 0.99$$

Figure 29A:
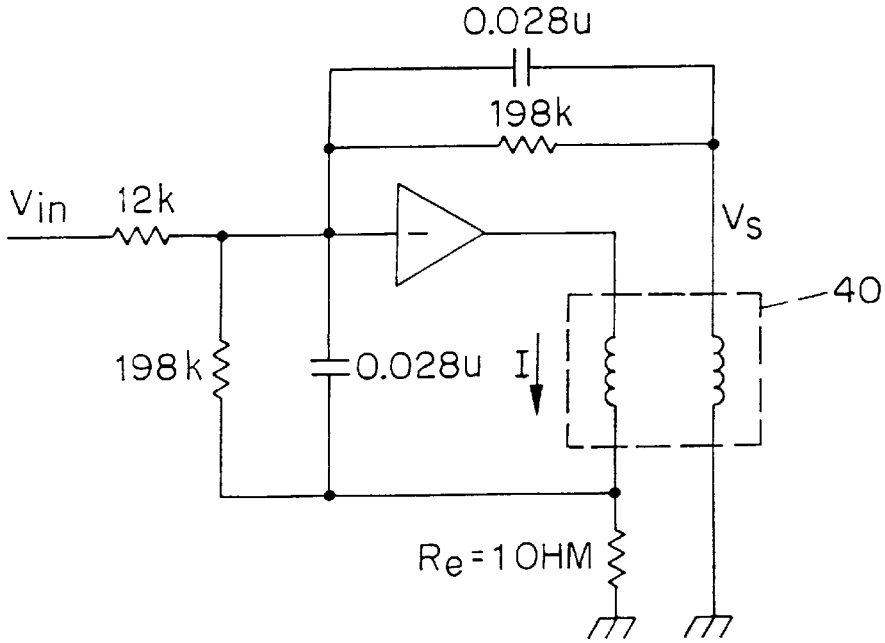
FIG. 29*a* is a circuit design applying all of the simplification schemes.
Figure 29B:
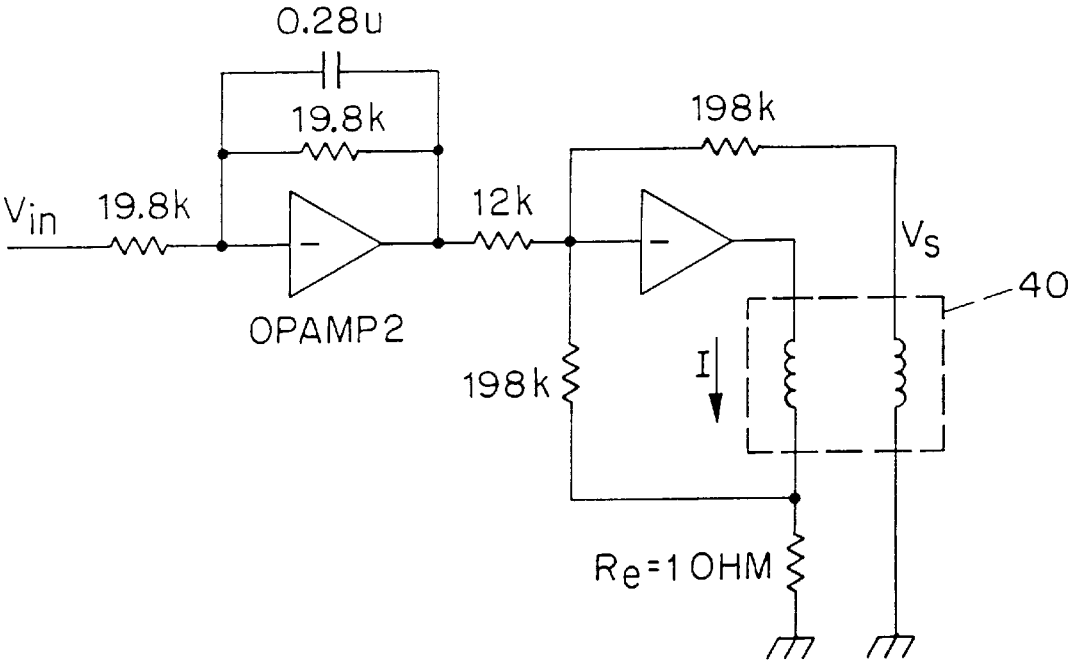
FIG. 29*b* is a circuit design eliminating G and using an op amp.
Figure 29C:
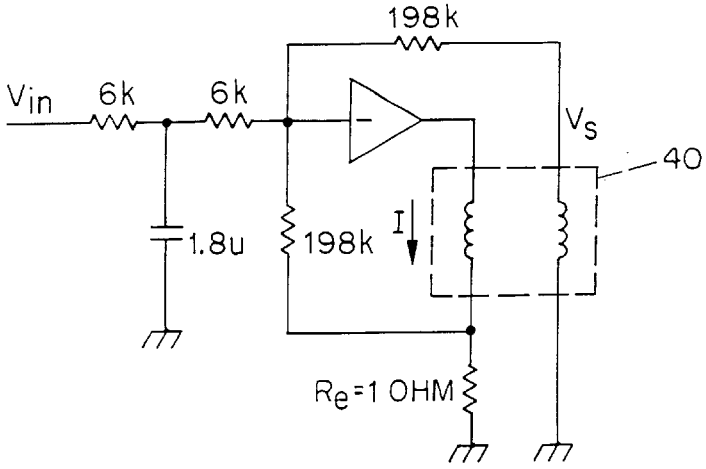
FIG. 29*c* is a circuit design using a capacitor between the input resistors to implement G.

Three circuit designs are shown in FIGS. 29*a,* 29*b,* and 29*c*. FIG. 29*b* takes out G and implements it using another op amp (opamp2). FIG. 29*c* uses a capacitor between the input resistors to implement G. The invention intends to cover all designs that are similarly derived.

Figure 30A:
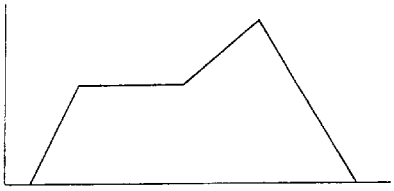
FIG. 30*a* shows a frequency response diagram without the lowpass filter implemented by G.
Figure 30B:
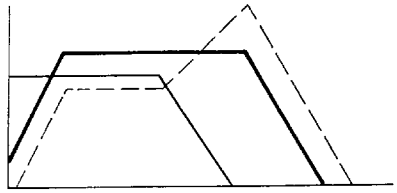
FIG. 30*b* shows a frequency response diagram implemented in G.

In this design, it is also interesting to note that how the flat response is achieved using such a simple circuit design, as shown in FIGS. 30*a* and 30*b*. FIG. 30*a* shows the response without the lowpass filter implemented by G, and FIG. 30*b* shows the filter implemented by G. In FIG. 30*b* the solid line is the filter implemented in G. The heavy line is the response of the composite system, shifted for clarity.

Design Example 4

Another interesting case is when the combination of simplification scheme (b) and (c). In this case, the Z and G are:

$$Z=0.99+0.000011\ s$$

Figure 31A:
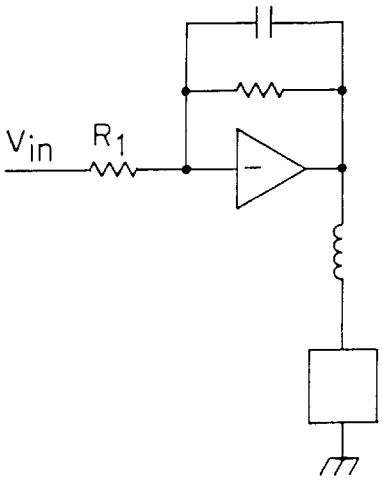
FIG. 31*a* shows a direct-drive design which does not use sensing coil or current feedback.
Figure 31B:
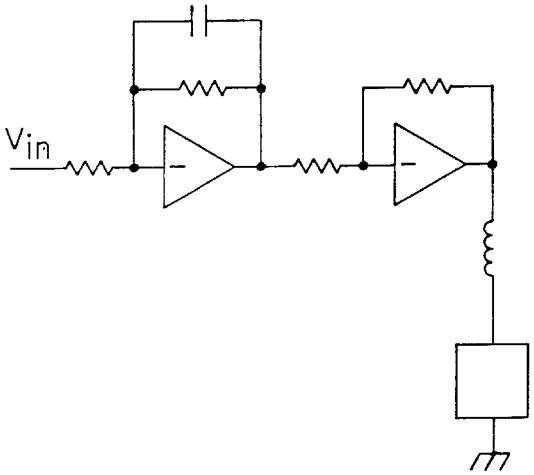
FIG. 31*b* shows an alternative direct-drive design which does not use sensing coil or current feedback.

In addition to the design that employs both sensing voice coil and current feedback, this combination also permit a direct drive configuration which does not use sensing voice coil or current feedback, as shown in FIGS. 31*a* and 31*b*.

While I have only shown three examples on combining $$G = \frac{K}{s+172}$$

simplification schemes, the invention comprehends all possible combinations of simplification schemes (a), (b), and (c).

After proposing sensing voice coil and current feedback to implement the complex impedance loading scheme, I will show how one can also implement it using solely current feedback. In this case, the output impedance of the driving amp contains a negative resistance intended to cancel the voice coil dc resistance. In the following, I show the circuit designs example using solely current feedback. These designs may look like the one proposed in U.S. Pat. No. 4,118,600. To be able to differentiate the two, I also show the closest circuit designs that are proposed in U.S. Pat. No. 4,118,600.

Design Example 5

Figure 32A:
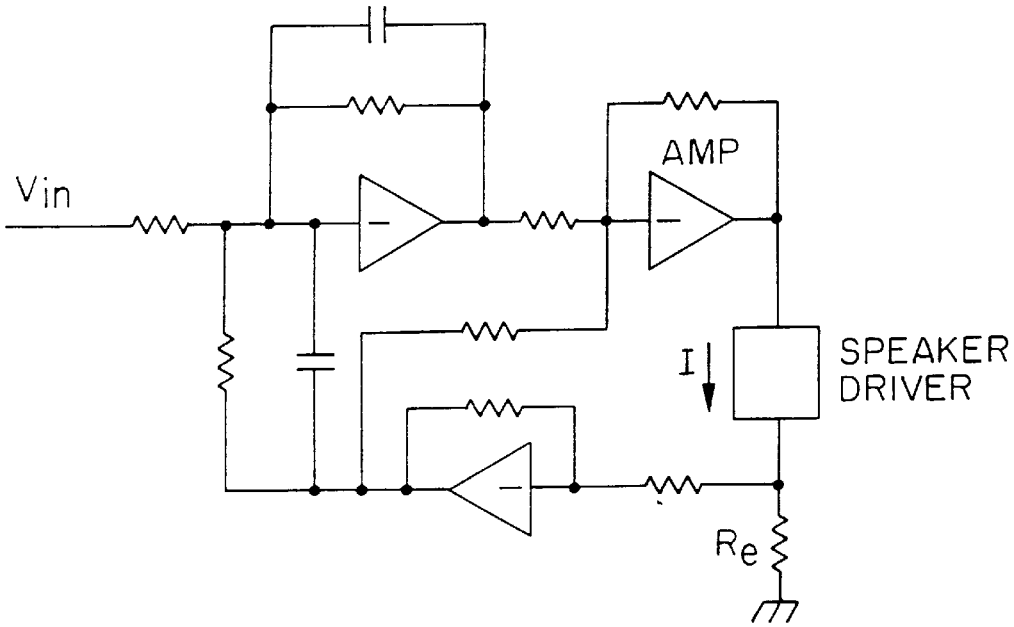
FIG. 32*a* shows a circuit using solely current feedback in a second design example.
Figure 32B:
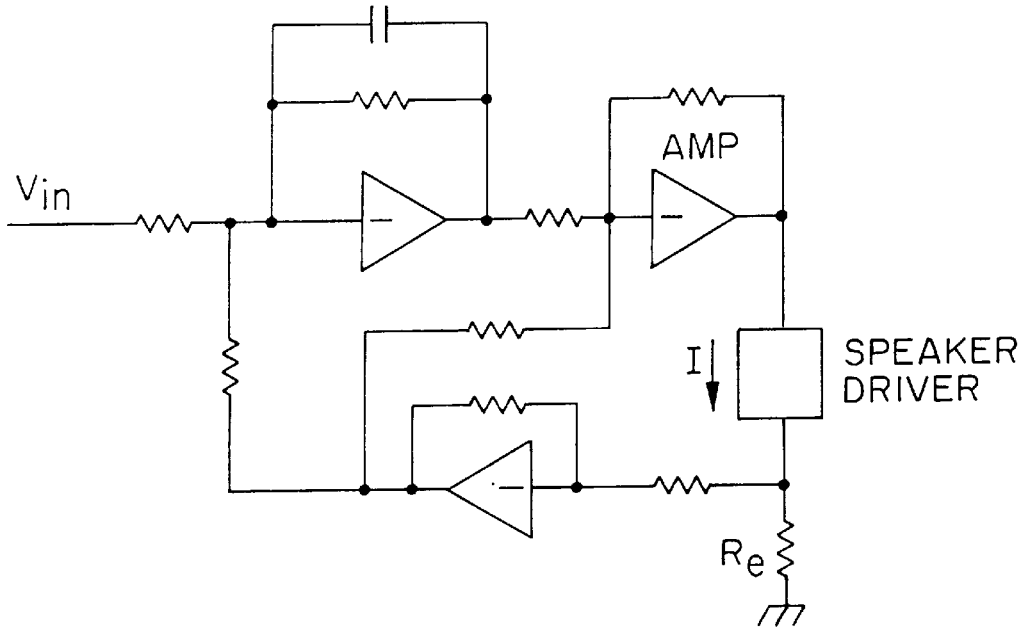
FIG. 32*b* shows in contradistinction a current-feedback circuit according to the prior art.

Using the design example given in Design example 2, the circuit using solely current feedback is shown in FIG. 32*a*. FIG. 32*b* is the circuit design proposed in the prior art.

Design Example 6

Figure 33A:
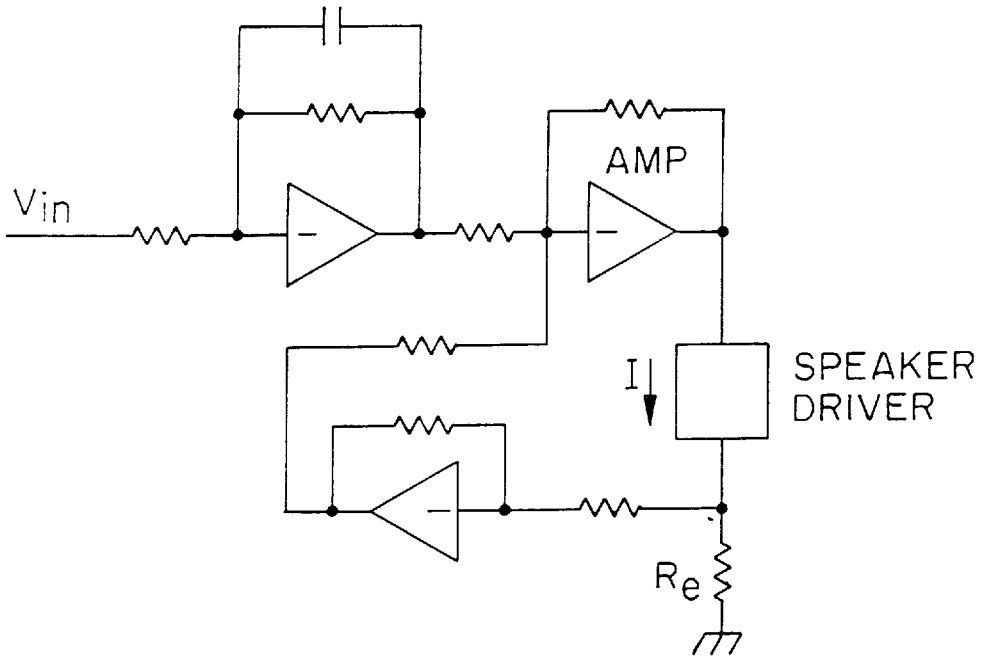
FIG. 33*a* shows a circuit using solely current feedback in a third design example.
Figure 33B:
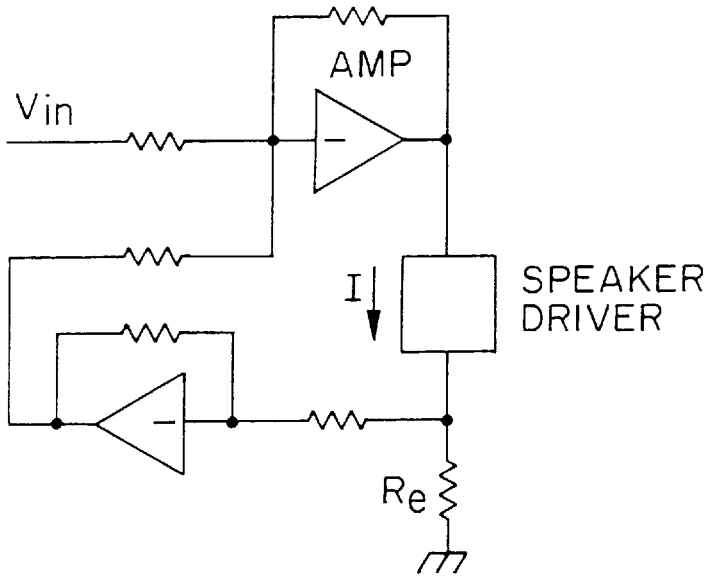
FIG. 33*b* shows in contradistinction a current-feedback circuit according to the prior art.

Similarly, the circuit using solely current feedback on Design example 3, is shown in FIG. 33*a*. FIG. 33*b* shows the circuit design proposed in the prior art.

The complex loading scheme can be regarded as a system with a bandpass or low-pass filter implicitly built-in using only one amp. Moreover, in most cases the shaded boxes in FIG. 22*a* can be implemented out of passive components. As a result, one can easily tailor the frequency response to suit one's crossover requirement. In the following, I will consider a multi-driver system that consists of at least two separate modules: one for bass, using the scheme described herein, and the second module for higher frequency, which will be referred to as the midrange module. Furthermore, I assume that the frequency response $T_m(s)$ of the midrange module is a 2nd order, that is $$T_m(s) = \frac{Ks^2}{ps^2 + qs + r}$$

My goal is to design the frequency response of the bass module such that the composite system response (including the midrange module) is a flat all-pass. In this case, the frequency response $T_b(s)$ of the bass module (ignoring the terms for the bass response) should be:

$$T_b(s) = \frac{K}{p} \cdot \frac{qs + r}{ps^2 + qs + r}$$

and $$T_m(s) + T_b(s) = \frac{K}{p}$$

To achieve the above frequency response described by $T_b(s)$, one can design the Q and fp value of the high-end cut-off frequency of the complex impedance loading system such that it follows the following transfer function:

$$\frac{1}{ps^2 + qs + r}$$

After I come up with the G expression, I can modify the G by multiplying it with (qs+r), and some gain-control constant K', that is:

$$G' = K'G\ (qs+r)$$

Figures 17A, 17B, 17C:
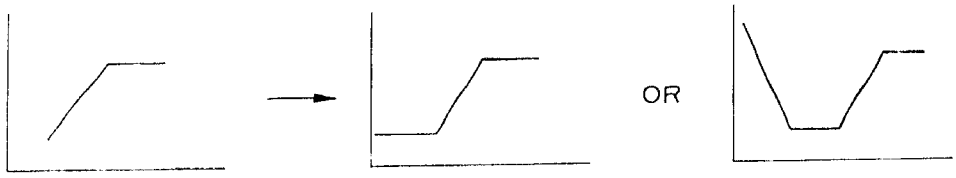
FIG. 17*a* shows the high-pass filter of FIG. 16*b;*
FIG. 17*b* shows the high-pass filter of FIG. 17*a* after incorporating a DC feedback signal.
FIG. 17*c* shows the high-pass filter of FIG. 17*a* with a still different transfer function.

Another way of implementing complex loading schemes is to directly modify the high-pass and low-pass filters of an existing simple impedence loading circuit to resolve real-world problems as described next. For instance, as mentioned previously, in order to ensure DC stability, I need to add DC feedback signal from the current signal (or the amp output). FIGS. 17*a,* 17*b,* and 17*c* show the possible new transfer function of the high-pass filter after incorporating the DC feedback signal. In FIG. 17*b* (for the circuits in FIGS. 9*a* and 9*b*), the new transfer function is:

$$\frac{1}{R} + \frac{S}{dS + e}$$

In FIG. 17*c* (refer to FIG. 11), the new transfer function is $$R + CS + \frac{S}{dS + e}$$

Figure 18:
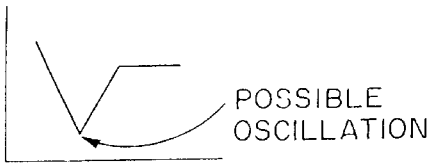
FIG. 18 shows the transfer function for the system of FIG. 11, in the special case in which $R_s$ is omitted.

In FIG. 11, the DC servo loop is different from the commonly seen ones (which has $C_s$ only, no $R_s$). Adding $R_s$ is to prevent a possible oscillation. FIG. 18 shows the transfer function if $R_s$ is not included.

What are shown in FIGS. 17*b* and 17*c* is the filter only for the current feedback signal. The network connecting the system input and the amp still has the original high-pass characteristics.

Figures 19A, 19B, 19C:
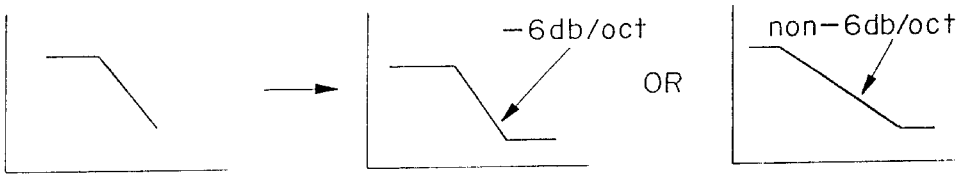
FIG. 19*a* shows the low-pass filter of FIG. 16*b;*
FIG. 19*b* shows the low-pass filter of FIG. 19*a* with a different transfer function.
FIG. 19*c* shows the low-pass filter of FIG. 19*a* employing a shallower slope of filter.

The low-pass filter can also be varied. FIG. 19 shows two possible variations of the low-pass section. The main purpose for these variations is to reduce the resonance peak at $f_p$ in FIG. 14. In FIG. 19*b,* a zero is added to the network. The new transfer function becomes (refer to FIGS. 9*a* and 9*b*):

$$\frac{1}{r} + \frac{1}{fs + g}$$

Alternatively, although this is thought to be less workable, it might be proposed to reduce the declining slope to smaller than 6 db/octave using a multi-pole and multi-zero network.

It should be appreciated that in the system according to the invention, the positional or motional feedback is a negative feedback, and that the current feedback is also a negative feedback.

Figure 20A:
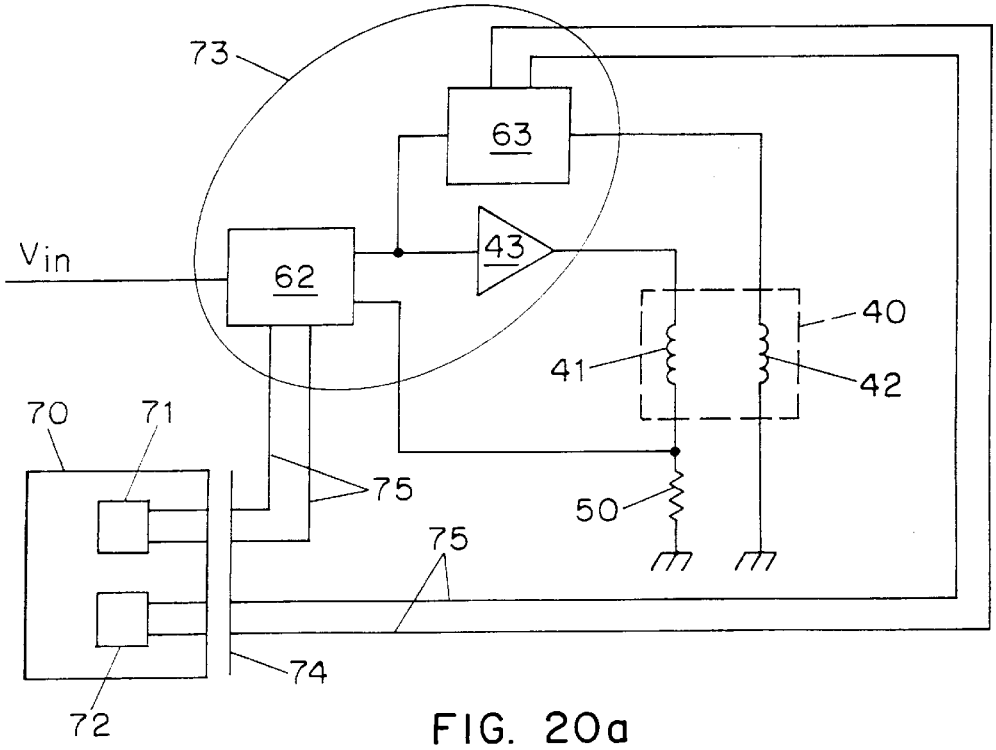
FIGS. 20*a* and 20*b* show in functional block diagram form embodiments of the invention employing a plug-in card.

FIG. 20*a* shows an embodiment of the invention in which the speaker is distributed with a matched circuit card 70. Circuit card 70 has components 71, 72 associated with electrical/physical properties of the speaker. (In simpler embodiments the circuit card 70 has only one of components 71, 72.) The amplifier system (roughly, region 73 in FIG. 20) is generalized to work with a variety of different speakers. When a particular speaker is installed to the system, the plug-in card 72 is plugged in to connector 74. This permits component(s) 71 to be connected with circuitry 62, and permits component(s) 72 to be connected with circuitry 63. In this way the speaker and amplifier offer the benefits of the invention. In FIG. 20 the components 71, 72 are portrayed as resistors, but it should be understood that any of a number of different components, such as capacitors, inductors, or combinations of these, may be provided (in connection with appropriately arranged filters 62, 63) to customize the amplifier appropriately for the particular speaker being installed. It will also be appreciated that the wires 75 are depicted as four wires, but that some other number of wires would suffice depending on the particular circuitry 62, 63.

Figure 20B:
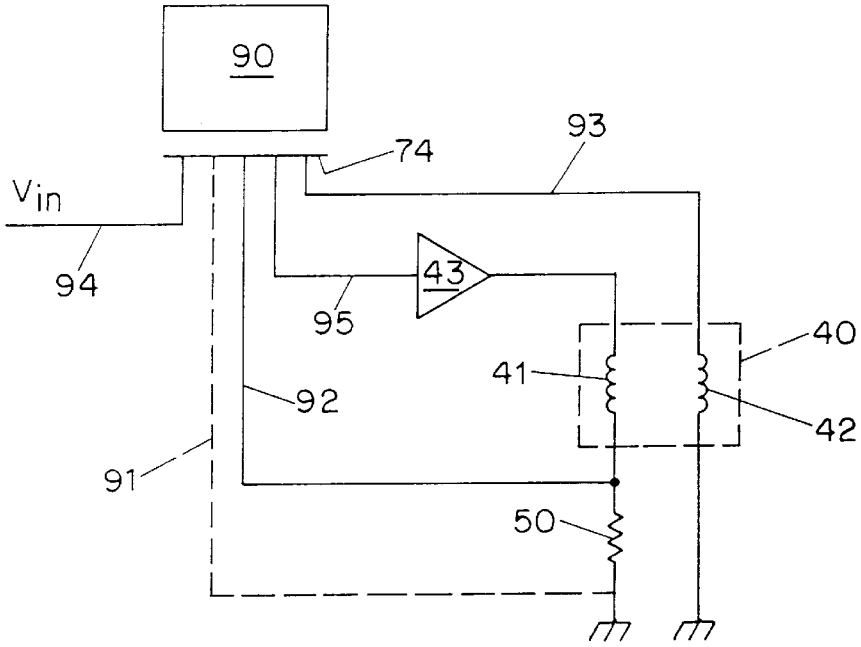

FIG. 20*b* shows yet another embodiment for use in a system according to the invention. In this embodiment a connector has a plurality of electrical contacts, said contacts including a first contact connected with the amplifier input via line 95, a second contact connected with the first voice coil's current sensing means via line 92, a third contact connected with the system signal input via line 94, and a fourth contact connected with the motional feedback sensor, in this figure a second voice coil, via line 93. Optionally a fifth contact is connected with the second end of the resistor 50 via line 91. In this way, a filter 90 may be connected with the connector. Its coupling of the second voice coil with the amplifier input defines a first feedback, its coupling of the resistor with the amplifier input defines a second feedback. It also couples the system signal input with the amplifier input, as a result of which an audio signal on the audio signal input is reproduced in the speaker. The filter 90 is matched to the physical and accoustical qualities of the speaker.

Figure 21:
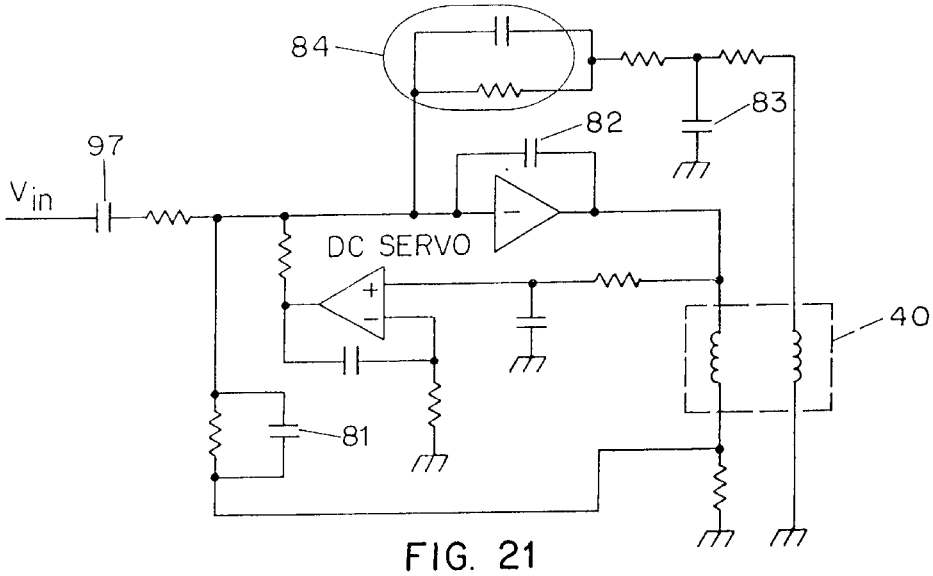
FIG. 21 shows in schematic form a prototype embodiment of the invention.

FIG. 21 is the schematic of a prototype that has been built. In this configuration only the mechanical mass and friction have to be modified. Additional components, namely capacitors 81, 82, and 83 are not required for the invention but provide better stability at high frequency. In this embodiment, the positional feedback is by means of a filter 84 which might best be characterized as a modified low-pass filter. A coupling capacitor 97 couples the input audio signal with the amplifier.

Those skilled in the art will appreciate that stated in its most general terms, the invention presents a way of providing improved bass response. To accomplish this end, first and second negative feedback paths are provided. The first negative feedback means couples the notional measurement means output with the amplifier input; and the second negative feedback means couples a current measurement means electrically coupled with the voice coil driven by the amplifier with the amplifier input. In the simplest possible embodiments, one or the other of the two negative feedback means includes a frequency characteristic correcting circuit which is set to have variable gain dependent on the frequency of the input signal. Lastly, complex impedence loading schemes are described to address the voice coil induction issues.

I claim:

1. A sound reproduction system comprising an amplifier system, a speaker, and first and second negative feedback means;

the speaker having a diaphragm, a first voice coil mechanically coupled with the diaphragm, and notional measurement means coupled with the diaphragm, the notional measurement means having an output;

the amplifier system comprising an amplifier with an input and an output, the amplifier output electrically coupled to the first voice coil;

the first feedback means comprising first circuitry coupling the notional measurement means output with the amplifier input, said feedback means exhibiting a characteristic, the reciprocal of said characteristic being a low-pass filter; and the second feedback means comprising a current measurement means electrically coupled with the first voice coil and having an output, and a high-pass filter coupling the current measurement means output with the amplifier input.

2. The system of claim 1 wherein the high-pass filter additionally couples a system input signal with the amplifier input.

3. The system of claim 1 wherein the speaker further comprises a coil former upon which the first voice coil is wound, and further comprises a second voice coil wound on the coil former, and wherein the first and second voice coils are disposed within a permanent magnetic field, the second voice coil comprising the motional measurement means.

4. The system of claim 1 wherein the speaker further comprises a piezoelectric sensor mechanically coupled with the diaphragm, the piezoelectric sensor having an electrical output indicative of deflection thereof, the piezoelectric sensor comprising the motional measurement means and the output of the piezoelectric sensor comprising the motional measurement means output.

5. The system of claim 1 wherein the current measurement means comprises a resistor disposed electrically in series with the first voice coil, the voltage drop across the resistor comprising the output of the current measurement means.

6. The system of claim 1 wherein the amplifier system further comprises a connector electrically coupled with the first and second feedback means, and a board removably connectable with the connector, said board comprising at least a first electrical component electrically coupled with the first feedback means and at least a second electrical component electrically coupled with the second feedback means.

7. An amplifier system comprising an amplifier and first and second negative feedback means;

the amplifier having an input and an output, the amplifier output adapted for electrical coupling with a speaker voice coil;

the first feedback means comprising first circuitry adapted for electrical coupling with a speaker diaphragm motional measurement means, the said first feedback means exhibiting a characteristic, the reciprocal of the said characteristic being a low-pass filter; and the second feedback means comprising a current measurement means adapted for electrical coupling with the speaker voice coil and having an output, and a high-pass filter coupling the current measurement means output with the amplifier input.

8. The system of claim 7 wherein the high-pass filter additionally couples a system input signal with the amplifier input.

9. The system of claim 7 wherein the current measurement means comprises a resistor disposed electrically in series with the first voice coil, the voltage drop across the resistor comprising the output of the current measurement means.

10. The system of claim 7 wherein the amplifier system further comprises a connector electrically coupled with the high-pass filter and with the low-pass filter, and a board removably connectable with the connector, said board comprising at least a first electrical component electrically coupled with the high-pass filter and at least a second electrical component electrically coupled with the low-pass filter.

11. A method of sound reproduction comprising:

electrically coupling an an amplifier system with a speaker, whereby the amplifier drives the speaker, the speaker having a diaphragm and a first voice coil mechanically coupled thereto;

providing a first negative feedback to the amplifier indicative of changes in the position of the diaphragm, said first feedback further characterized as the reciprocal of a low-passed function of the current; and providing a second negative feedback to the amplifier indicative of the current through the first voice coil, said second feedback further characterized as a high-passed function of the current.

12. The method of claim 11 wherein the step of providing the first feedback further comprises providing a second voice coil coupled to the diaphragm, voltage induced in the second voice coil being indicative of changes in the position of the diaphragm.

13. The method of claim 11 wherein the step of providing the first feedback further comprises providing a piezoelectric sensor mechanically coupled with the diaphragm, the piezoelectric sensor having an electrical output indicative of deflection thereof, voltage induced in the piezoelectric sensor being indicative of changes in the position of the diaphragm.

14. A sound reproduction system comprising an amplifier system, a speaker, and first and second negative feedback means;

the speaker having a diaphragm, a first voice coil mechanically coupled with the diaphragm, and notional measurement means coupled with the diaphragm, the motional measurement means having an output;

the amplifier system comprising an amplifier with an input and an output, the amplifier output electrically coupled to the first voice coil;

the first feedback means comprising first circuitry coupling the motional measurement means output with the amplifier input;

the second feedback means comprising a current measurement means electrically coupled with the first voice coil and having an output, and second circuitry coupling the current measurement means output with the amplifier input; and the characteristic of the said first circuitry being different from the characteristic of the said second circuitry.

15. The system of claim 14 wherein the second circuitry additionally couples a system input signal with the amplifier input.

16. The system of claim 14 wherein the speaker further comprises a coil former upon which the first voice coil is wound, and further comprises a second voice coil wound on the coil former, and wherein the first and second voice coils are disposed within a permanent magnetic field, the second voice coil comprising the notional measurement means.

17. The system of claim 14 wherein the speaker further comprises a piezoelectric sensor mechanically coupled with the diaphragm, the piezoelectric sensor having an electrical output indicative of deflection thereof, the piezoelectric sensor comprising the notional measurement means and the output of the piezoelectric sensor comprising the motional measurement means output.

18. The system of claim 14 wherein the current measurement means comprises a resistor disposed electrically in series with the first voice coil, the voltage drop across the resistor comprising the output of the current measurement means.

19. The system of claim 14 wherein the amplifier system further comprises a connector electrically coupled with the first circuitry and with the second circuitry, and a board removably connectable with the connector, said board comprising at least a first electrical component electrically coupled with the first circuitry and at least a second electrical component electrically coupled with the second circuitry.

20. An amplifier system comprising a amplifier and first and second negative feedback means;

the amplifier having an input and an output, the amplifier output adapted for electrical coupling with a speaker voice coil;

the first feedback means comprising first circuitry adapted for electrical coupling with a speaker diaphragm motional measurement means;

the second feedback means comprising a current measurement means adapted for electrical coupling with the speaker voice coil and having an output, and second circuitry coupling the current measurement means output with the amplifier input;

the characteristic of the said first circuitry being different from the characteristic of the said second circuitry.

21. The system of claim 20 wherein the second circuitry additionally couples a system input signal with the amplifier input.

22. The system of claim 20 wherein the current measurement means comprises a resistor disposed electrically in series with the first voice coil, the voltage drop across the resistor comprising the output of the current measurement means.

23. The system of claim 20 wherein the amplifier system further comprises a connector electrically coupled with the first circuitry and with the second circuitry, and a board removably connectable with the connector, said board comprising at least a first electrical component electrically coupled with the first circuitry and at least a second electrical component electrically coupled with the second circuitry.

24. A method of sound reproduction comprising:

electrically coupling an an amplifier system with a speaker, whereby the amplifier drives the speaker, the speaker having a diaphragm and a first voice coil mechanically coupled thereto;

providing a first negative feedback to the amplifier indicative of changes in the position of the diaphragm;

providing a second negative feedback to the amplifier indicative of the current through the first voice coil;

the characteristic of the said first negative feedback being different from the characteristic of the said second negative feedback.

25. The method of claim 24 wherein the step of providing the first feedback further comprises providing a second voice coil coupled to the diaphragm, voltage induced in the second voice coil being indicative of changes in the position of the diaphragm.

26. The method of claim 24 wherein the step of providing the first feedback further comprises providing a piezoelectric sensor mechanically coupled with the diaphragm, the piezoelectric sensor having an electrical output indicative of deflection thereof, voltage induced in the piezoelectric sensor being indicative of changes in the position of the diaphragm.

27. A system for sound reproduction comprising an amplifier with an input and an output, a speaker with a first voice coil wound on a former and a second coil wound on the same former, a resistor having first and second ends, the first end of the resistor connected with a first end of the first voice coil, the fist voice coil driven by the amplifier output, a connector, the connector having a plurality of electrical contacts, said contacts comprising a first contact connected with the amplifier input, a second contact connected with said first end of the first voice coil, a third contact connected with a system signal input and a fourth contact connected with the second voice coil, and a filter connected with the connector; said filter coupling the second voice coil with the amplifier input thereby defining a first negative feedback, said filter coupling the resistor with the amplifier input thereby defining a second negative feedback, and said filter coupling the system signal input with the amplifier input, whereby an audio signal on the audio signal input is reproduced in the speaker.

28. A sound reproduction system comprising an amplifier system, a speaker, and first and second negative feedback means;

the speaker having a diaphragm, a first voice coil mechanically coupled with the diaphragm, and motional measurement means coupled with the diaphragm, the motional measurement means having an output;

the amplifier system comprising an amplifier with an input and an output, the amplifier output electrically coupled to the first voice coil;

the first feedback means comprising first circuitry coupling the motional measurement means output with the amplifier input; and the second feedback means comprising a current measurement means electrically coupled with the first voice coil and having an output, and second circuitry coupling the current measurement means output with the amplifier input, said second circuitry including a frequency characteristic correction circuit which is set to have variable gain dependent on the frequency of its input signal.

29. A sound reproduction system comprising an amplifier system, a speaker, and first and second negative feedback means;

the speaker having a diaphragm, a first voice coil mechanically coupled with the diaphragm, and motional measurement means coupled with the diaphragm, the motional measurement means having an output;

the amplifier system comprising an amplifier with an input and an output, the amplifier output electrically coupled to the first voice coil;

the first feedback means comprising first circuitry coupling the notional measurement means output with the amplifier input, said first circuitry including a frequency characteristic correction circuit which is set to have variable gain dependent on the frequency of its input signal;

the second feedback means comprising a current measurement means electrically coupled with the first voice coil and having an output, and second circuitry coupling the current measurement means output with the amplifier input.

30. A sound reproduction system to convert a electrical signal to acoustic signal of a frequency range, comprising an amplifier system, a speaker, and the first and second negative feedback means;

the speaker having a diaphragm, a first voice coil mechanically coupled with the diaphragm, and motional measurement means coupled with the diaphragm, the notional measurement means having an output;

the amplifier system comprising an amplifier with an input and an output, the amplifier output electrically coupled to the first voice coil;

the first feedback means comprising first circuitry coupling the motional measurement means output with the amplifier input, said first circuitry exhibiting a first characteristic; and the second feedback means comprising a current measurement means electrically coupled with the first voice coil and having an output, and second circuitry coupling the current measurement means output with the amplifier inputs, said second circuitry exhibiting a second characteristic.

31. The system of claim 30 wherein the ratio of said second characteristic and said first characteristic exhibits a characteristic corresponding to the impedance characteristic of a plurality of impedances disposed in a parallel circuit.

32. The system of claim 30 wherein said impedance characteristic is band-pass.

33. The system of claim 30 wherein the ratio of said second characteristic and said first characteristic exhibits a characteristic corresponding to the impedance characteristic of a plurality of impedances disposed in a serial circuit.

34. The system of claim 30 wherein the ratio of said second characteristic and said first characteristic exhibits a positive slope between a first and a second frequency, a substantially constant value between said second frequency and a third frequency, a negative slope between said third frequency and a fourth frequency, a substantially constant value between said fourth frequency and a fifth frequency, and a positive slope between said fifth frequency and a sixth frequency.

35. The system of claim 30 wherein the ratio of said second characteristic and said first characteristic exhibits a positive slope between a first and a second frequency, a substantially constant value between said second frequency and a third frequency, a positive slope between said third frequency and a fourth frequency, a substantially constant value between said fourth frequency and a fifth frequency, and a positive slope between said fifth frequency and a sixth frequency.

36. The system of claim 30 wherein the ratio of said second characteristic and said first characteristic exhibits a substantially constant value between a first and a second frequency, a negative slope between said second frequency and a third frequency, a substantially constant value between said third frequency and a fourth frequency, and a positive slope between said fourth frequency and a fifth frequency.

37. The system of claim 30 wherein the ratio of said second characteristic and said first characteristic exhibits a substantially constant value between a first and a second frequency, a positive slope between said second frequency and a third frequency, a substantially constant value between said third frequency and a fourth frequency, and a positive slope above said fourth frequency.

38. The system of claim 30 wherein the ratio of said second characteristic and said first characteristic exhibits a substantially constant value between a first and a second frequency, a positive slope between said second frequency and a third frequency, and a substantially constant value between said third frequency and a fourth frequency.

39. The system of claim 30 wherein the ratio of said second characteristic and said first characteristic exhibits a substantially constant value between a first and a second frequency, a negative slope between said second frequency and a third frequency, and a substantially constant value between said third frequency and a fourth.

40. The system of claim 30 wherein the ratio of said second characteristic and said first characteristic exhibits a positive slope between a first and a second frequency, a substantially constant value between said second frequency and a third frequency, and a positive slope between said third frequency and a fourth frequency.

41. The system of claim 30 wherein the ratio of said second characteristic and said first characteristic exhibits a substantially constant value between a first and a second frequency, and a positive slope between said second frequency and a third frequency.

42. The system of claim 30 wherein the ratio of said second characteristic and said first characteristic exhibits a positive slope between a first and a second frequency, a negative value between said second frequency and a third frequency, and a positive slope between said third frequency and a fourth frequency.

43. The system of claim 30 wherein the ratio of said second characteristic and said first characteristic exhibits a substantially constant value between a first and a second frequency, a negative slope between said second frequency and a third frequency, and a positive slope between said third frequency and a fourth frequency.

44. A sound reproduction system to convert the electrical signal to acoustic signal of a frequency range, comprising an amplifier system, a equalization means, a speaker, and a first and second negative feedback means;

the speaker having a diaphragm, a first voice coil mechanically coupled with the diaphragm, and motional measurement means coupled with the diaphragm, the motional measurement means having an output;

the amplifier system comprising an amplifier with an input and an output, the amplifier output electrically coupled to a first voice coil;

the equalization means receives system input signal and has an output coupled to the input of said amplifier system;

the first feedback means comprising first circuitry coupling the notional measurement means output with the amplifier input, said first circuitry exhibiting a first characteristic;

the second feedback means comprising a current measurement means electrically coupled with the first voice coil and having an output, and second circuitry coupling the current measurement means output with the amplifier inputs, said second circuitry exhibiting a second characteristic; and when the system input bypasses the equalization means and couple to the said amplifier input, said system exhibits a peak at the high end of the frequency reproduction range.

45. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a positive slope between a first and a second frequency, a substantially constant value between said second frequency and a third frequency, a negative slope between said third frequency and a fourth frequency, a substantially constant value between said fourth frequency and a fifth frequency, and a positive slope between said fifth frequency and a sixth frequency.

46. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a positive slope between a first and a second frequency, a substantially constant value between said second frequency and a third frequency, positive slope between said third frequency and a fourth frequency, a substantially constant value between said fourth frequency and a fifth frequency, and a positive slope between said fifth frequency and a sixth frequency.

47. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a substantially constant value between a first and a second frequency, a negative slope between said second frequency and a third frequency, a substantially constant value between said third frequency and a fourth frequency, and a positive slope between said fourth frequency and a fifth frequency.

48. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a substantially constant value between a first and a second frequency, a positive slope between said second frequency and a third frequency, and a substantially constant value between said third and a fourth frequency.

49. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a positive slope between a first and a second frequency, a substantially constant value between said second frequency and a third frequency, and a positive slope between said third frequency and a fourth frequency.

50. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a substantial constant value between a first and a second frequency, and a positive slope between said second frequency and a third frequency.

51. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a positive slope between a first and a second frequency, and a negative slope between said second frequency and a third frequency, and a positive slope between said third frequency and a fourth frequency.

52. A sound reproduction system to convert the electrical signal to acoustic signal of a frequency range, comprising an amplifier system, a speaker; the amplifier system comprising an amplifier with an input and an output, the amplifier output electrically coupled to the voice coil of said speaker, said amplifier system has an output impedance substantially equivalent to a negative resistance in series with a plurality of impedances disposed in a serial circuit; said negative resistance being substantially equal to the dc resistance of said voice coil; and the said plurality of impedances disposed in said serial circuit exhibits a substantially constant value between a first and a second frequency, a negative slope between said second frequency and a third frequency, and a positive slope between said third frequency and a fourth frequency.

53. A sound reproduction system to convert the electrical signal to acoustic signal of a frequency range, comprising an amplifier system, a speaker, an inductor, and an equalization means;

the speaker when driven with a substantially constant signal source, exhibits a peak around the high end of the reproduction frequency range;

the equalization means receiving signal from system input and has an output, said equalization means exhibiting a low pass characteristic above a frequency within said reproduction frequency range;

said amplifier system having an input terminal receiving signal from said equalization means; and said speaker is coupled to the output of said amplifier system via an inductor.

54. A sound reproduction system to convert the electrical signal to acoustic signal of a frequency range, comprising an amplifier system, a speaker, an inductor, and an equalization means; the speaker when driven with a substantially constant signal source, exhibits a peak around the high end of the reproduction frequency range;

the equalization means receiving signal from system input and has an output, said equalization means exhibiting a substantially constant value between a first frequency and a second frequency, and a negative slope between said second frequency and a third frequency; said amplifier system having an input terminal receiving signal from said equalization means; and said speaker is coupled to the output of said amplifier system via an inductor.

* * * * *